US008603327B2

(12) United States Patent
Painter et al.

(10) Patent No.: US 8,603,327 B2
(45) **Date of Patent: *Dec. 10, 2013**

(54) ANALOGUE IONIC LIQUIDS FOR THE SEPARATION AND RECOVERY OF HYDROCARBONS FROM PARTICULATE MATTER

(75) Inventors: Paul Painter, Boalsburg, PA (US); Phil Williams, State College, PA (US); Ehren Mannebach, Fond du Lac, WI (US); Aron Lupinsky, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/252,523

(22) Filed: Oct. 4, 2011

(65) Prior Publication Data

US 2012/0048783 A1 Mar. 1, 2012

Related U.S. Application Data

(63) Continuation-in-part of application No. 12/854,553, filed on Aug. 11, 2010.

(60) Provisional application No. 61/236,405, filed on Aug. 24, 2009.

(51) Int. Cl.
*C10G 1/04* (2006.01)

(52) U.S. Cl.
USPC ..... 208/390; 208/391; 208/424; 208/425; 208/428

(58) Field of Classification Search
USPC ..... 208/390, 391, 424, 425, 428; 210/664, 210/660, 663
See application file for complete search history.

(56) References Cited

U.S. PATENT DOCUMENTS

| | | | | |
|---|---|---|---|---|
| 3,330,757 | A | 7/1967 | Bichard | |
| 3,487,003 | A | 12/1969 | Baillie et al. | |
| 3,723,310 | A | 3/1973 | Lang et al. | |
| 4,172,025 | A * | 10/1979 | Porteous et al. | 208/425 |
| 4,929,341 | A | 5/1990 | Thirumalachar | |
| 2007/0111903 | A1* | 5/2007 | Engel et al. | 507/261 |
| 2009/0054226 | A1* | 2/2009 | Mironov et al. | 502/168 |
| 2011/0108466 | A1 | 5/2011 | Petcavich | |

FOREIGN PATENT DOCUMENTS

| | | |
|---|---|---|
| CA | 1152920 | 8/1983 |
| WO | 03/086605 | 10/2003 |
| WO | 2005/028592 | 3/2005 |

OTHER PUBLICATIONS

Allen, E. W. "Process water treatment in Canada's oil sands industry: I. Target pollutants and treatment objectives", J. Environ. Eng. Sci., vol. 7, pp. 123-138, (2008).
Allen, E. W., "Process water treatment in Canada's oil sands industry: II. A review of emerging technologies", J. Environ. Eng. Sci., vol. 7, pp. 499-524, (2008).
Amyes, T. L., et al., "Formation and stability of N-heterocyclic carbenes in water: The carbon acid pKa of imidazolium cations in aqueous solution", J. Am. Chem. Soc., vol. 126, pp. 4366-4374, (2004).
Blasucci, et al., "Single Component, Reversible Ionic Liquids for Energy Applications", Fuel, vol. 89, pp. 1315-1319, (2010).
Budziak, C. J., et al., "Studies of fines in bitumen extracted from oil sands by heat-centrifugation", Fuel, vol. 67, pp. 1633-1638, (1988).
Dai, Q., et al., "Bitumen-Sand interaction in oil sand processing", Fuel, vol. 74, Issue 12, pp. 1858-1864, (1995).
Heinberg, R., "The Party's Over: Oil, War and the Fate of Industrial Societies", New Society Publishers, full reference and synopsis, (2005).
Houlihan, R., et al., "Recent enhancements in mined oil sands bitumen extraction technology", J Can. Petroleum Technol., vol. 26, pp. 91-96, (1987).
Koel, et al., "Ionic Liquids for Oil Shale Treatment", "Green Industrial Applications of Ionic Liquids", Edited by R. D. Rogers, et al., NATO Science Series II: Mathematics, Physics and Chemistry, Kluwe Academic Publishers, pp. 193-208, (2002).
Koel, "Use of Ionic Liquids in Oil Shale Processing, Ionic Liquids IIIB: Fundamentals, Progress, Challenges and Opportunities", Edited by R. D. Rogers, et al., ACS Symposium Series, pp. 72-82, (2005).
Liu, J., et al., "Studies on bitumen-silica interaction in aqueous solutions by atomic force microscopy", Mendeley, Langmuir, vol. 19, pp. 3911-3920, (2003).
Masliyah, J., et al., "Understanding Water-Based Bitumen Extraction from Athabasca Oil Sands", Canadian J. Chem. Eng., vol. 82, Issue 4, pp. 628-654, (Aug. 2004).
Patell, et al., "The Dissolution of Kerogens in Ionic Liquids", "Green Industrial Applications of Ionic Liquids", Edited by R. D. Rogers, et al., Nato Science Series, Kluwe Academic Publishers, pp. 499-510, (2002).

(Continued)

*Primary Examiner* — Prem C Singh
*Assistant Examiner* — Michelle Stein
(74) *Attorney, Agent, or Firm* — McDermott Will & Emery LLP

(57) ABSTRACT

Systems, methods and compositions for the separation and recovery of hydrocarbons from particulate matter are herein disclosed. According to one embodiment, a method includes contacting particulate matter with at least one analogue ionic liquid. The particulate matter contains at least one hydrocarbon and at least one solid particulate. When the particulate matter is contacted with the analogue ionic liquid, the hydrocarbon dissociates from the solid particulate to form a multiphase system.

20 Claims, 21 Drawing Sheets

(56) References Cited

OTHER PUBLICATIONS

Plechkova, N. V., et al., "Applications of ionic liquids in the chemical industry", Chem. Soc. Rev., vol. 37, pp. 123-150, (2008).
Toma, S., et al., "Are Ionic Liquids Suitable Media for Organocatalytic Reactions?", European Journal of Organic Chemistry, vol. 3, pp. 321-327, (2009).
Weingartner, W., "Understanding ionic liquids at the molecular level: Facts, problems and controversies", Angew. Chem. Int. Ed., vol. 47, pp. 654-670, (2008).
International Search Report PCT/US2010/45155, International Filing Date: Aug. 11, 2010.
Written Opinion of the International Searching Authority for PCT/US2010/45155.
Supplementary European Search Report (EPO) mailed on Feb. 1, 2013 in International Application No. EP10 81 2485. (7 pages).
Painter et al., "Recovery of Bitumen from oil or tar sands using ionic liquids," Energy & Fuels (2009) 24(2): 1094-1098.
Williams et al., "Recovery of Bitumen from low-grade oil sands using ionic liquids," Energy & Fuels (2010) 24(3): 2172-2173.
Hogshead et al. "Studies of bitumen—silica and oil—silica interactions in ionic liquids", Energy & Fuels (2011), 25:293-299.
Painter et al. "Recovery of bitumen from Utah tar sands using ionic liquids", Energy & Fuels (2010) 24:5081-5088.

* cited by examiner

ANALOGUE IONIC LIQUIDS FOR THE SEPARATION AND RECOVERY OF HYDROCARBONS FROM PARTICULATE MATTER

CROSS REFERENCE TO RELATED APPLICATIONS

This application is a continuation-in-part of U.S. application Ser. No. 12/854,553, entitled "SYSTEMS, METHODS AND COMPOSITIONS FOR THE SEPARATION AND RECOVERY OF HYDROCARBONS FROM PARTICULATE MATTER," filed on Aug. 11, 2010 which claims priority from U.S. provisional application No. 61/236,405, entitled "METHOD FOR RECOVERING BITUMEN FROM OIL SANDS," filed on Aug. 24, 2009, which are both incorporated by reference in their entirety, for all purposes, herein.

STATEMENT AS TO FEDERALLY SPONSORED RESEARCH

This invention was made with government support under Grant No. DMR1045998, awarded by the National Science Foundation. The Government has certain rights in the invention.

FIELD OF TECHNOLOGY

The present application is directed to systems, methods and compositions for the separation and recovery of hydrocarbons from particulate matter. More specifically, the present application is directed to analogue ionic liquids for the separation and recovery of hydrocarbons from particulate matter.

BACKGROUND

Oil sands, also referred to as tar sands, contain a significant quantity of the world's known oil reserves. Large deposits of oil sands are found in Canada, Venezuela and in the United States in eastern Utah. Oil sands are a complex mixture of sands, clays, water and viscous hydrocarbon compounds, known as bitumen. Typically, the extraction and separation of bitumen from oil sands involves the use of significant amounts of energy and heated water. Approximately 19 barrels of water are required for every barrel of oil produced. Water, sodium hydroxide (NaOH) and other additives are mixed with the oil sands to form a slurry. The NaOH releases surfactants from the oil sands and improves bitumen recovery. The slurry is conditioned by mixing and/or shearing the slurry to detach bitumen from the oil sands particles. Bitumen is separated from water by aeration to form an oil containing froth that can be skimmed off the surface of the water. The remaining process water is a complex mixture of alkaline water, dissolved salts, minerals, residual bitumen, surfactants released from the bitumen and other materials used in processing. Additional processing of the water is required to remove residual bitumen The process water is ultimately stored in tailing ponds and is acutely toxic to aquatic life. The process water recycled from tailings ponds causes scaling and corrosion problems that often adversely affect the optimum recovery of bitumen. In addition, very fine mineral particles such as clays are co-extracted with the bitumen and must be removed in subsequent processing steps that ultimately reduce the yield of bitumen. Although a large proportion of the water used in the process (about 16 barrels) is now recycled from tailing ponds, the production of each barrel of oil still requires importing an additional 3 barrels of fresh water. The necessity of large quantities of water has prevented the recovery of bitumen deposits from oils sands in arid areas such as Utah.

Several other related scenarios require the removal of oil from sand or solid particles in oil and gas operations. For example, heavy oil (e.g., between 10° and 20° API gravity) is also found in sand deposits, particularly in Venezuela and Canada. Recovery of heavy oil from sand typically involves expensive thermal methods such as, steam injection. A technique widely used in Canada called cold heavy oil production with sand (CHOPS) has also been used to separate heavy oil from sand. CHOPS involves the continuous production of sand and oil, which presents separation and disposal constraints.

During drilling operations drilling fluids used to cool and clean the drill bit become contaminated with formation cuttings. Formation cuttings must be removed from the drilling fluid before reuse of drilling fluid. During production operations, crude oil produced from unconsolidated formations can also contain sand including mixtures of various minerals and silt that require removal prior to processing the oil. The oil coated sand must also be cleaned before disposal or re-depositing.

An increase in offshore drilling operations has also increased the risk of coastal communities and beaches being exposed to crude oil produced from offshore oil rigs. As described above, current methods for the removal of oil from sand require large quantities of water and energy. Physical methods for removing oil from beach sand including the use of shovels, cleaning forks and lift and screen systems require large amounts of labor and do not efficiently remove all the decontaminate from the sand.

In view of the foregoing, there is a need in the field of art for improved systems, methods and compositions for the separation and recovery of hydrocarbons from particulate matter.

SUMMARY

Systems, methods and compositions for the separation and recovery of hydrocarbons from particulate matter are herein disclosed. According to one embodiment, a method includes contacting particulate matter with at least one analogue ionic liquid. The particulate matter contains at least one hydrocarbon and at least one solid particulate. When the particulate matter is contacted with the analogue ionic liquid, the hydrocarbon dissociates from the solid particulate to form a multiphase system.

The foregoing and other objects, features and advantages of the present disclosure will become more readily apparent from the following detailed description of exemplary embodiments as disclosed herein.

BRIEF DESCRIPTION OF THE DRAWINGS

Embodiments of the present application are described, by way of example only, with reference to the attached Figures, wherein.

DETAILED DESCRIPTION

Figure 1:
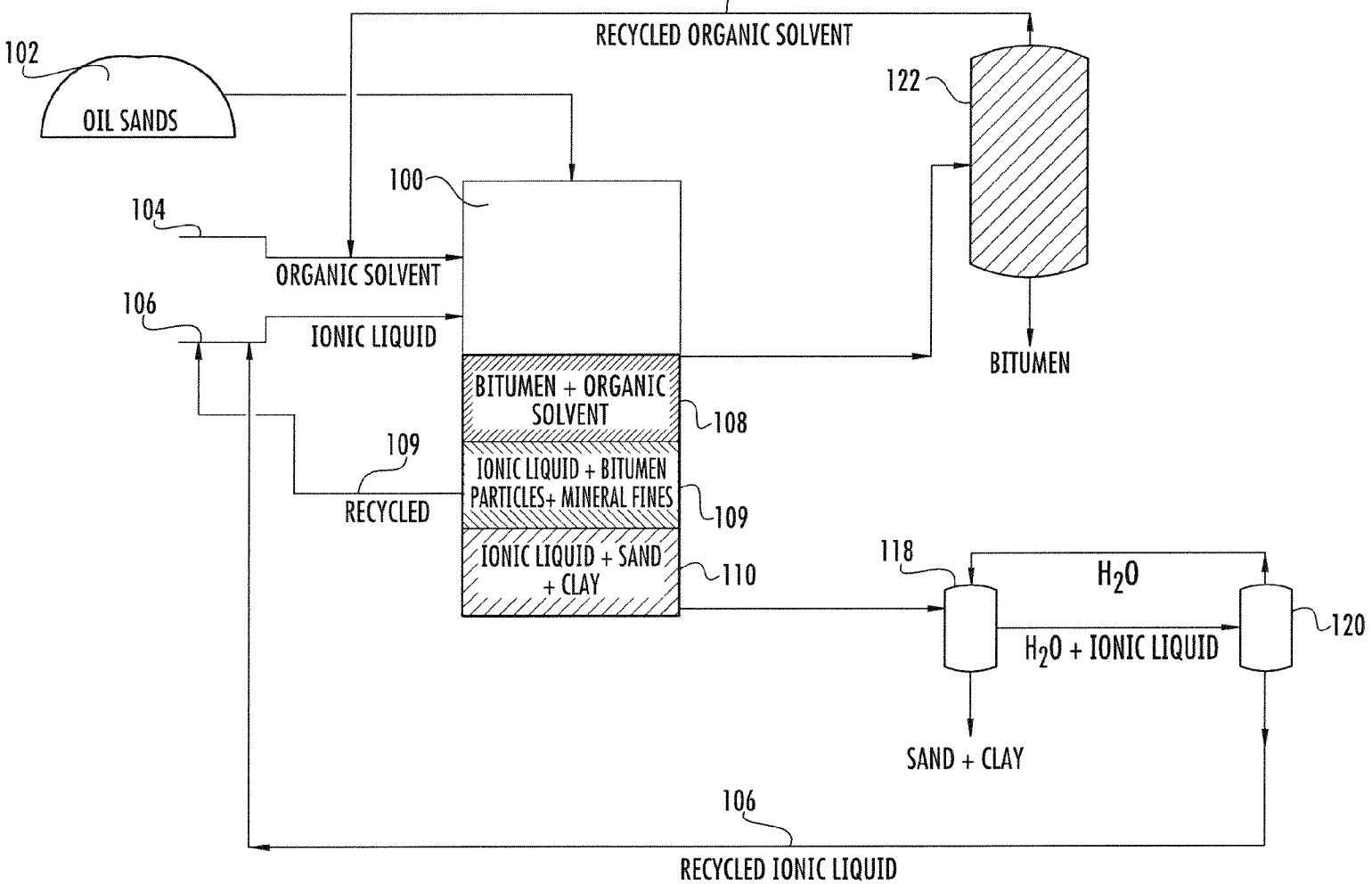
FIG. 1 illustrates an exemplary system for recovering bitumen from oil sands according to one embodiment.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, methods, procedures and components have not been described in detail so as not to obscure the embodiments described herein. The terms oil sands and tar sands are used interchangeably throughout this disclosure.

Systems, methods and compositions for the separation and recovery of hydrocarbons from particulate matter are herein disclosed. One or more ionic liquids or analogue ionic liquids herein disclosed can be mixed with or otherwise placed in contact with particulate matter comprising at least one hydrocarbon and at least one solid particulate. When contacted with an ionic liquid or analogue ionic liquid, the hydrocarbon separates or dissociates from the solid particulate. The particulate matter can include, but is not limited to the following: oil sands, drilling fluid containing drill cuttings, tailing pond material, crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate.

The ionic liquids disclosed herein are thermally stable, chemically stable, have negligible vapor pressure, and are soluble in water and insoluble in organic solvents, such as non-polar hydrocarbon solvents. The ionic liquids substantially degrade into a corresponding amino acid at room temperature when reacted with hydrogen peroxide and ions, such as iron ions. Therefore, the ionic liquids can be contained or reacted into innocuous amino acids if they are inadvertently or deliberately released into the environment. The ionic liquids can include at least one compound formed from imidazolium cations and at least one anion. The ionic liquids can include at least one compound including, but not limited to: 1-butyl-2,3-dimethyl-imidazolium; borontetrafluoride; 1-butyl-2,3-dimethyl-imidazolium; trifluoro-methanesulfonate; 1-butyl-3-methyl-imidazolium; trifluoromethanesulfonate; 1-butyl-3-methyl-imidazolium chloride; 1-ethyl-3-methyl-imidazolium chloride; tetraalkyl ammonium salts; pyrrolidinium based salts or any other ionic liquid that is soluble in water and insoluble in non-polar organic solvents.

The ionic liquids disclosed herein are used to separate particulate matter at relatively low temperatures of below 100° C., preferably below 50° C. and more preferably 25° C. and lower. Optionally, the separation temperature can be raised to lower the viscosity of the hydrocarbon being separated and aid in separation from particulate material. The separation temperature can be raised by any heating means including electric heating means, electromagnetic heating means, microwave heating means or other heating means.

One or more analogue ionic liquids herein disclosed can also be mixed with or otherwise placed in contact with particulate matter comprising at least one hydrocarbon and at least one solid particulate to effect separation of the hydrocarbon from the solid particulate. When contacted with the analogue ionic liquids, the hydrocarbon separates or dissociates from the solid particulate. This separation is promoted by the presence of an organic solvent, particularly if the hydrocarbon to be separated is highly viscous. Examples of such viscous hydrocarbons are bitumen and tar. The particulate matter can include, but is not limited to the following: oil sands, drilling fluid containing drill cuttings, tailing pond material, crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate.

Analogue ionic liquids herein disclosed are relatively non-toxic and biodegradable. Analogue ionic liquids herein disclosed include at least two components. The analogue ionic liquids have melting temperatures that are significantly less than the melting temperature of the components making up the analogue ionic liquids. Analogue ionic liquids can include, but are not limited to at least two components selected from the following components: tetralkyl ammonium salts, urea, carboxylic acids, glycerol, metal salts, water, fructose, sucrose, glucose, organic halide salts and organic hydrogen bond donors.

The tetralkyl ammonium salts can include, but are not limited to 2-hydroxyethyl(trimethyl) ammonium chloride (choline chloride), 2-hydroxyethyl(trimethyl) ammonium bromide, 2-hydroxyethyl(triethyl) ammonium chloride, 2-hydroxyethyl(trimethyl) ammonium tetrafluoroborate.

The organic halide salts can include, but are not limited to methyl triphenyl phosphonium bromide.

The organic hydrogen bond donors can include, but are not limited to glycerol, ethylene glycol, or triethylene glycol.

An organic solvent and/or water can also be added to or mixed with the ionic liquid or analogue ionic liquid and the particulate matter to obtain optimal separation of hydrocarbon from the solid particulate. The organic solvent lowers the viscosity of the hydrocarbon and aids in the separation from the solid particulate. The organic solvents herein disclosed dissolve non-polar hydrocarbons such as bitumen, oil or drilling fluid and are immiscible with the ionic liquids disclosed above. The organic solvent can include, but is not limited to at least one of the following compounds: toluene, naphtha, hexane, kerosene, paraffinic solvents or any other non-polar hydrocarbon solvent that dissolves the hydrocarbon and is immiscible with the ionic liquid.

FIG. 1 illustrates an exemplary system for recovering bitumen from oil sands 102 according to one embodiment. Oil sands 102 can include sand, clay, other minerals, and bitumen. The oil sands 102 are mixed with an organic solvent 104 and an ionic liquid 106 in a primary mixing vessel 100. The primary mixing vessel 100 can be any vessel known in the art for mixing or containing liquids, solids or slurries. When mixed with the organic solvent 104 and the ionic liquid 106, the bitumen is separated from the oil sands 102 and a three-phase system including a top phase, middle phase and bottom phase is formed.

The bottom phase 110 consists of ionic liquid 106 with suspended sand and clay. The middle phase 109 consists of ionic liquid 106 with small amounts of dissolved or suspended bitumen particles and mineral fines. The top phase 108 consists of organic solvent 104 and bitumen. The bottom phase 110, the middle phase 109 and the top phase 108 can be drained from the primary mixing vessel 100 for further processing and/or recycling through the system.

The bitumen in the top phase 108 can be recovered after separating or evaporating the organic solvent 104 from the bitumen in a primary separator 122. The primary separator 122 can be a decanter, distillation column, pressure separator, centrifuge, open tank, hydroclone, settling chamber or other separator known in the art for separating mixtures. The organic solvent 104 can be condensed, recycled to the primary mixing vessel 100 and mixed with additional oil sands 102, organic solvent 104 and ionic liquid 106 to achieve three-phase separation.

The middle phase 109 and substantially all of the ionic liquid 106 introduced into the system can be retained in the mixing vessel 100. In this way, the ionic liquid 106 in the middle phase 109 is not moved throughout the system. If removed for additional processing, the middle phase 109 can be recycled to the primary mixing vessel 100 and mixed with additional oil sands 102, organic solvent 104 and ionic liquid 106 to achieve three-phase separation. The concentration of bitumen within the middle phase 109 is expected to reach equilibrium and therefore will not accumulate. If necessary, organic solvent 104 can be added to the middle phase 109 in an additional processing step to separate any entrained or suspended bitumen from the ionic liquid 106 before the ionic liquid 106 is recycled to the primary mixing vessel 100.

The bottom phase 110 consisting of ionic liquid 106 with suspended sand and clay can be fed into a secondary mixing vessel 118 and mixed with water to form a solution of ionic liquid 106, water, and suspended sand and clay particles. The mixing vessel 118 can be any vessel known in the art for mixing or containing liquids, solids or slurries. The sand and clay can be filtered from the ionic liquid and water. The ionic liquid 106 can be recovered after separating or evaporating the water in a secondary separator 120. The separator 120 can be a decanter, distillation column, pressure separator, centrifuge, open tank or other separator known in the art for separating mixtures. After separation and/or evaporation, the water can be condensed before it is recycled to the secondary mixing vessel 118. The ionic liquid 106 can be recycled to the primary mixing vessel 100 and mixed with additional oil sands 102, organic solvent 104 and ionic liquid 106 to achieve three-phase separation.

The exemplary system for recovering bitumen from oil sands illustrated in FIG. 1 can also be used to separate other particulate matter including, but not limited to the following: oil sands, drilling fluid containing drill cuttings, crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate. The ionic liquid 106 and organic solvent 104 can be mixed with or otherwise placed in contact with the particulate matter to separate or dissociate the hydrocarbon from the solid particulate and recover the hydrocarbon as described above.

Figure 2:
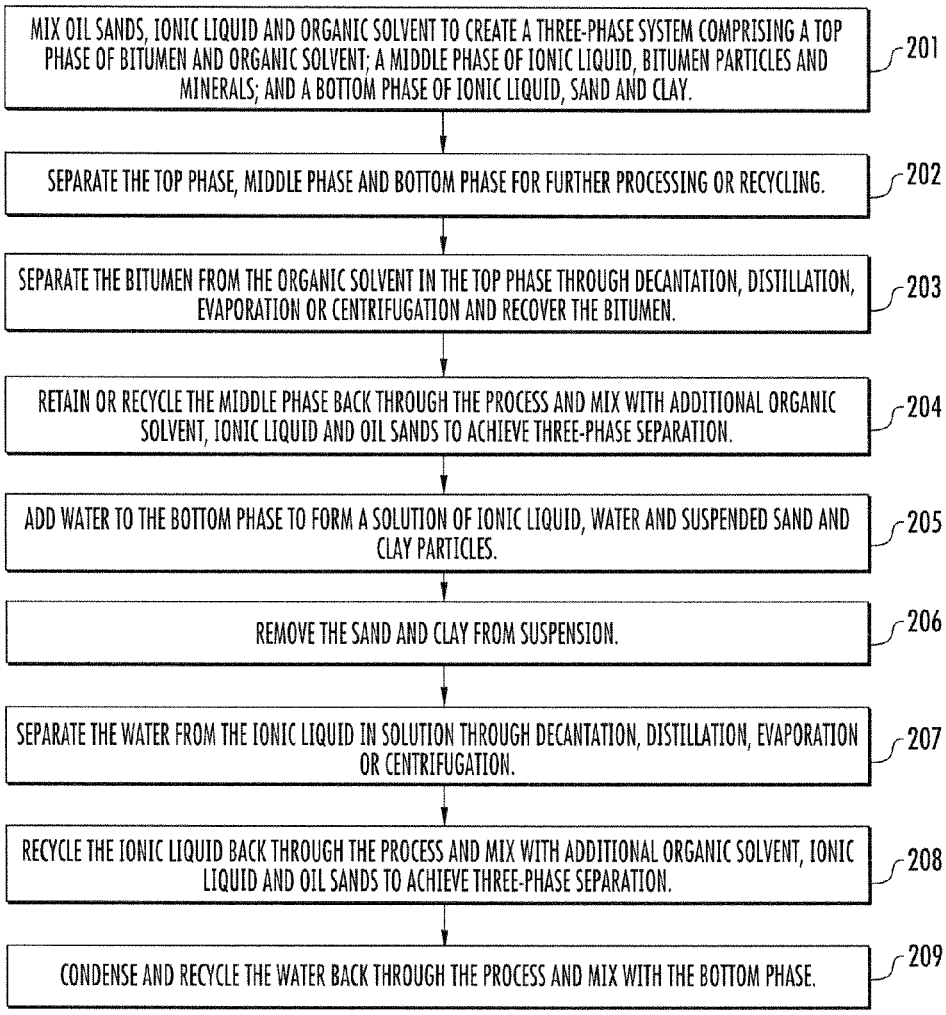
FIG. 2 illustrates a flow chart of an exemplary process for recovering bitumen from oil sands according to one embodiment.

FIG. 2 illustrates a flow chart of an exemplary process for recovering bitumen from oil sands according to one embodiment. The oil sands are mixed with an organic solvent and an ionic liquid at step 201 to form a three-phase system including a top phase, middle phase and bottom phase. The top phase consists of organic solvent and bitumen. The middle phase consists of ionic liquid with small amounts of dissolved bitumen particles and mineral fines. The bottom phase consists of ionic liquid with suspended sand and clay. The top phase, middle phase and bottom phase may be separated at step 202 for further processing or recycling back through the process.

At step 203, the bitumen and the organic solvent in the top phase are separated through decantation, distillation, evaporation or centrifugation and the bitumen is recovered. The organic solvent can be condensed, recycled and mixed with additional oil sands, organic solvent and ionic liquid to achieve three-phase separation.

At step 204, the middle phase is recycled and mixed with additional organic solvent, ionic liquid and oil sands to achieve three-phase separation. Optionally, the middle phase and/or substantially all of the ionic liquid can be retained in a primary mixing vessel within which the original oil sands, organic solvent and ionic liquid are mixed.

At step 205, water is added to the bottom phase to form a solution of water, ionic liquid and suspended sand and clay particles. The sand and clay is removed from suspension at step 206 through filtration. At step 207, the water is separated from the ionic liquid through decantation, distillation, evaporation or centrifugation and the ionic liquid is recovered. At step 208 the ionic liquid is recycled and mixed with additional organic solvent, ionic liquid and oil sands to achieve three-phase separation. The water can be condensed, recycled and mixed with the bottom phase at step 209 to separate additional ionic liquid from sand and clay.

The exemplary process for recovering bitumen from oil sands illustrated in FIG. 2 can also be used to separate other particulate matter including, but not limited to the following: oil sands, drilling fluid containing drill cuttings, crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate. The ionic liquid and organic solvent can be mixed with or otherwise placed in contact with the particulate matter to separate the hydrocarbon from the solid particulate and recover the hydrocarbon as described above.

Figure 3:
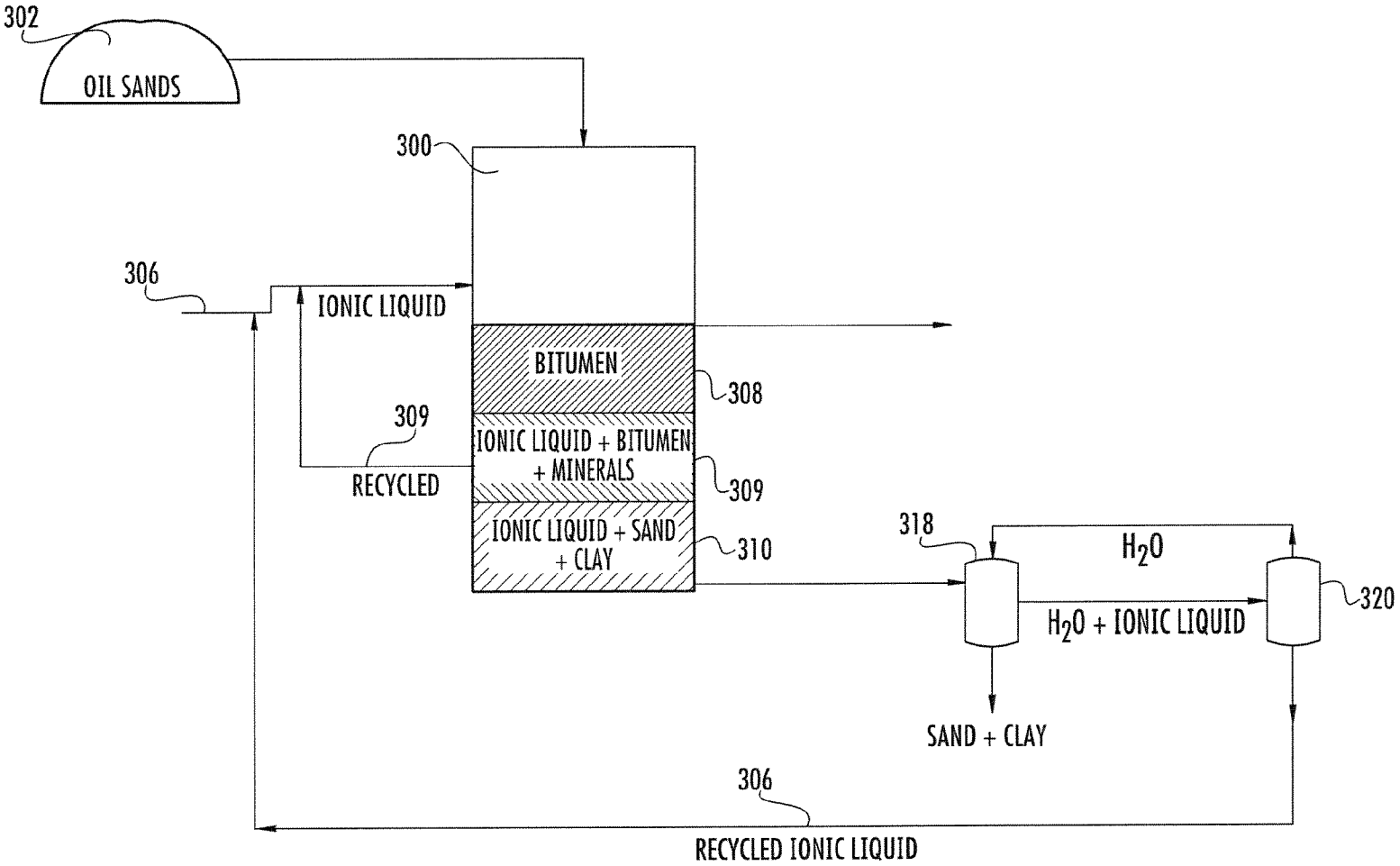
FIG. 3 illustrates an exemplary system for recovering bitumen from oil sands according to another embodiment.

FIG. 3 illustrates an exemplary system for recovering bitumen from oil sands 302 according to another embodiment. Oil sands 302 can include sand, clay, other minerals, and bitumen. The oil sands 302 are mixed with an ionic liquid 306 in a primary mixing vessel 300. The primary mixing vessel 300 can be any vessel known in the art for mixing or containing liquids, solids or slurries. When mixed with the ionic liquid 306, the bitumen is separated from the oil sands 302 and a three-phase system including a top phase, middle phase and bottom phase is formed. The bottom phase 310 consists of ionic liquid 306, sand and clay slurry. The middle phase 309 consists of ionic liquid 306, with some bitumen and minerals. The top phase 308 consists of bitumen. The bottom phase 310, the middle phase 309 and the top phase 308 can be drained from the primary mixing vessel 300 and the bitumen can be recovered.

The middle phase 309 and substantially all of the ionic liquid 306 introduced into the system can be retained in bulk in the mixing vessel 300. In this way, the ionic liquid 306 in the middle phase 309 is not moved throughout the system. If removed for additional processing, the middle phase 309 can be recycled to the primary mixing vessel 300 and mixed with additional oil sands 302 and ionic liquid 306 to achieve three-phase separation. The bitumen within the recycled middle phase 309 is expected to reach equilibrium and therefore will not accumulate.

The bottom phase 310 containing ionic liquid 106, sand and clay slurry can be fed into a secondary mixing vessel 318 and mixed with water to form a solution of ionic liquid 306, water, and suspended sand and clay particles. The mixing vessel 318 can be any vessel known in the art for mixing or containing liquids, solids or slurries. The sand and clay can be filtered from the ionic liquid and water. The ionic liquid 306 can be recovered by separating and/or evaporating the water in a secondary separator 320. The separator 320 can be a decanter, distillation column, pressure separator, centrifuge, open tank hydroclone, settling chamber or other separator known in the art for separating mixtures. After separation and/or evaporation, the water can be condensed before it is recycled to the secondary mixing vessel 318. The ionic liquid 306 can be recycled to the primary mixing vessel 300 and mixed with additional oil sands 302 and ionic liquid 306 to achieve three-phase separation.

The exemplary system for recovering bitumen from oil sands illustrated in FIG. 3 can also be used to separate other particulate matter including, but not limited to the following: oil sands, drilling fluid containing drill cuttings, crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate. The ionic liquid 306 can be mixed with or otherwise placed in contact with the particulate matter to separate or dissociate the hydrocarbon from the solid particulate and recover the hydrocarbon as described above.

Figure 4:
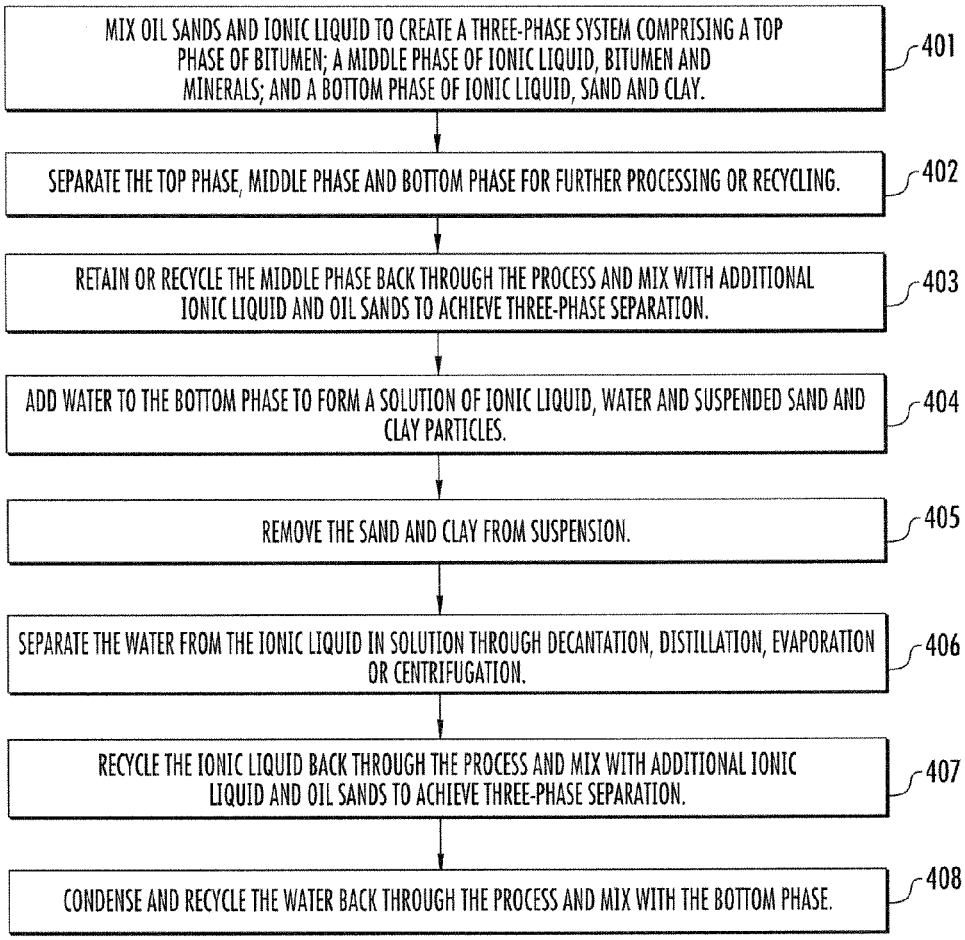
FIG. 4 illustrates a flow chart of an exemplary process for recovering bitumen from oil sands according to another embodiment.

FIG. 4 illustrates a flow chart of an exemplary process for recovering bitumen from oil sands according to another embodiment. The oil sands are mixed with an ionic liquid at step 401 to form a three-phase system including a top phase, middle phase and bottom phase. The top phase consists of bitumen. The middle phase consists of ionic liquid, with some bitumen and minerals. The bottom phase is ionic liquid, sand and clay slurry. The top phase, middle phase and bottom phase can be separated at step 402 for further processing or recycling back through the process.

At step 403, the middle phase is recycled and mixed with additional ionic liquid and oil sands to achieve three-phase separation. Optionally, the middle phase and/or substantially all of the ionic liquid can be retained in a primary mixing vessel within which the original oil sands and ionic liquid are mixed.

At step 404, water is added to the bottom phase to form a solution of water, ionic liquid and suspended sand and clay particles. The sand and clay is removed from the solution at step 405 through filtration. At step 406, the water is separated from the ionic liquid through decantation, distillation, evaporation or centrifugation and the ionic liquid is recovered. At step 407 the ionic liquid is recycled and mixed with additional ionic liquid and oil sands to achieve three-phase separation. The water can be condensed, recycled and mixed with the bottom phase at step 408 to separate additional ionic liquid from sand and clay.

The exemplary process for recovering bitumen from oil sands illustrated in FIG. 4 can also be used to separate other particulate matter including, but not limited to the following: oil sands, drilling fluid containing drill cuttings, crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate. The ionic liquid can be mixed with or otherwise placed in contact with the particulate matter to separate or dissociate the hydrocarbon from the solid particulate and recover the hydrocarbon as described above.

Figure 5:
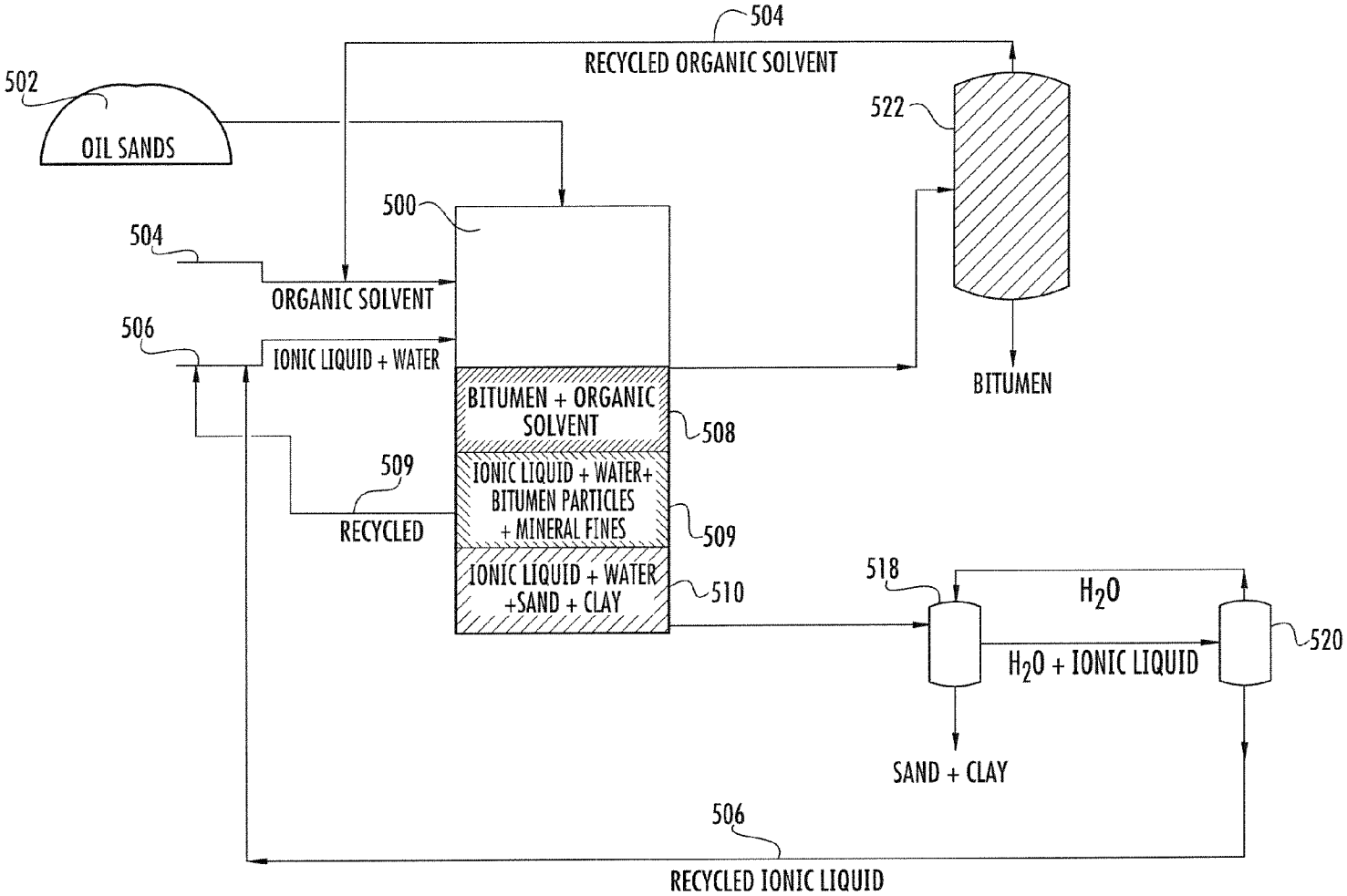
FIG. 5 illustrates an exemplary system for recovering bitumen from oil sands according to another embodiment.

FIG. 5 illustrates an exemplary system for recovering bitumen from oil sands according to another embodiment. Oil sands 502 can include sand, clay, other minerals, and bitumen. The oil sands 502 are mixed with or otherwise placed in contact with an ionic liquid 506, water and optionally an organic solvent 504 in a primary mixing vessel 500 or other separation vessel or column. The primary mixing vessel 500 can be any vessel known in the art for mixing or containing liquids, solids or slurries.

The water may be present within the oil sands in order to economically transport or pump the oil sands to the process facility. Water may also be added to the system to dilute the ionic liquid and reduce cost. When mixed with the organic solvent 504, ionic liquid 506 and water, the bitumen is separated from the oil sands 502 and a three-phase system including a top phase, middle phase and bottom phase is formed. The bottom phase 510 consists of ionic liquid 506, water and suspended sand and clay. The middle phase 509 consists of ionic liquid 506, water and small amounts of dissolved or suspended bitumen particles and mineral fines. The top phase 508 consists of organic solvent 504 and bitumen. The bottom phase 510, the middle phase 509 and the top phase 508 can be drained from the primary mixing vessel 500 for further processing and/or recycling through the system.

The bitumen in the top phase 508 can be recovered after separating or evaporating the organic solvent 504 from the bitumen in a primary separator 522. The primary separator 522 can be a decanter, distillation column, pressure separator, centrifuge, open tank, hydroclone, settling chamber or other separator known in the art for separating mixtures. The organic solvent 504 can be condensed, recycled to the primary mixing vessel 500 and mixed with additional oil sands 502, organic solvent 504 and ionic liquid 506 to achieve three-phase separation.

The middle phase 509 and substantially all of the ionic liquid 506 introduced into the system can be retained in the mixing vessel 500. In this way, the ionic liquid 506 in the middle phase 509 is not moved throughout the system. If removed for additional processing, the middle phase 509 can be recycled to the primary mixing vessel 500 and mixed with additional oil sands 502, organic solvent 504 and ionic liquid 506 to achieve three-phase separation. The concentration of bitumen within the middle phase 509 is expected to reach equilibrium and therefore will not accumulate. If necessary, organic solvent 504 can be added to the middle phase 509 in an additional processing step to separate any entrained or suspended bitumen from the ionic liquid 506 before the ionic liquid 506 is processed and/or recycled to the primary mixing vessel 500.

The bottom phase 510 consisting of ionic liquid 506, water and suspended sand and clay can be fed into a secondary mixing vessel 518 and mixed with additional water (if necessary) to form a solution of ionic liquid 506, water, and suspended sand and clay particles. The mixing vessel 518 can be any vessel known in the art for mixing or containing liquids, solids or slurries. The sand and clay can be filtered from the ionic liquid and water. The ionic liquid 506 can be recovered after separating or evaporating the water in a secondary separator 520. The separator 520 can be a decanter, distillation column, pressure separator, centrifuge, open tank or other separator known in the art for separating mixtures. After separation and/or evaporation, the water can be condensed before it is recycled to the secondary mixing vessel 518 or primary mixing vessel 500. The ionic liquid 506 can be recycled to the primary mixing vessel 500 and mixed with additional oil sands 502, organic solvent 504 and ionic liquid 506 to achieve three-phase separation.

The exemplary system for recovering bitumen from oil sands illustrated in FIG. 5 can also be used to separate other particulate matter including, but not limited to the following: oil sands, drilling fluid containing drill cuttings, crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate. The ionic liquid 506, water and optionally organic solvent 504 can be mixed with or otherwise placed in contact with the particulate matter to separate or dissociate the hydrocarbon from the solid particulate and recover the hydrocarbon as described above.

Figure 6:
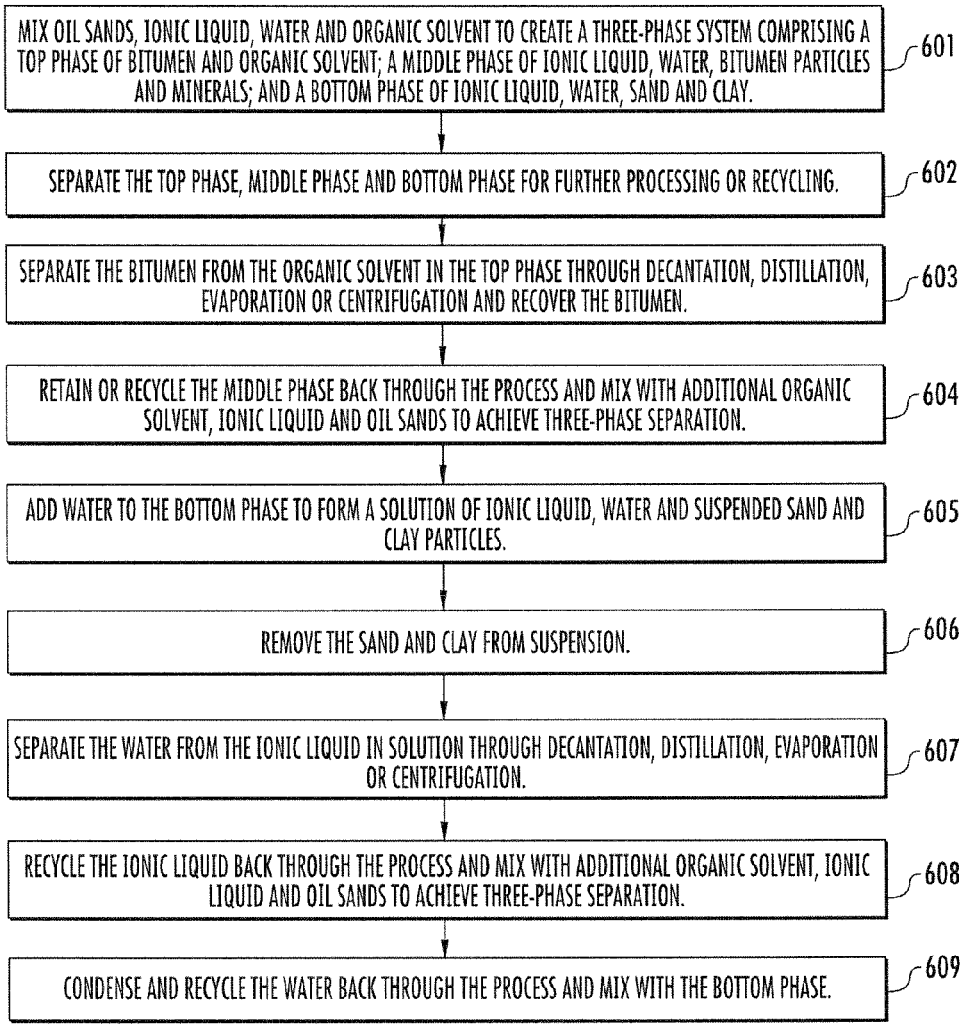
FIG. 6 illustrates a flow chart of an exemplary process for recovering bitumen from oil sands according to another embodiment.

FIG. 6 illustrates a flow chart of an exemplary process for recovering bitumen from oil sands according to one embodiment. The oil sands are mixed with an organic solvent, an ionic liquid and water at step 601 to form a three-phase system including a top phase, middle phase and bottom phase. The top phase consists of organic solvent and bitumen. The middle phase consists of ionic liquid, water and small amounts of dissolved bitumen particles and mineral fines. The bottom phase consists of water, ionic liquid and suspended sand and clay. The top phase, middle phase and bottom phase may be separated at step 602 for further processing or recycling back through the process.

At step 603, the bitumen and the organic solvent in the top phase are separated through decantation, distillation, evaporation or centrifugation and the bitumen is recovered. The organic solvent can be condensed, recycled and mixed with additional oil sands, organic solvent and ionic liquid to achieve three-phase separation.

At step 604, the middle phase is recycled and mixed with additional organic solvent, ionic liquid and oil sands to achieve three-phase separation. Optionally, the middle phase and/or substantially all of the ionic liquid can be retained in a primary mixing vessel within which the original oil sands, organic solvent, ionic liquid and water are mixed.

At step 605, water is added to the bottom phase to form a solution of water, ionic liquid and suspended sand and clay particles. The sand and clay is removed from suspension at step 606 through filtration. At step 607, the water is separated from the ionic liquid through decantation, distillation, evaporation or centrifugation and the ionic liquid is recovered. At step 608 the ionic liquid is recycled and mixed with additional organic solvent, ionic liquid and oil sands to achieve three-phase separation. The water can be condensed, recycled and mixed with the bottom phase at step 609 to separate additional ionic liquid from sand and clay.

The exemplary process for recovering bitumen from oil sands illustrated in FIG. 6 can also be used to separate other particulate matter including, but not limited to the following: oil sands, drilling fluid containing drill cuttings, tailing pond material, crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate. The ionic liquid, water and optionally organic solvent can be mixed with or otherwise placed in contact with particulate matter to separate or dissociate the hydrocarbon from the solid particulate and recover the hydrocarbon as described above.

One or more analogue ionic liquids herein disclosed can also be mixed with or otherwise placed in contact with particulate matter comprising at least one hydrocarbon and at least one solid particulate to effect separation of the hydrocarbon from the solid particulate. When contacted with the analogue ionic liquids, the hydrocarbon separates or dissociates from the solid particulate. This separation is promoted by the presence of an organic solvent, particularly if the hydrocarbon to be separated is highly viscous. Examples of such viscous hydrocarbons are bitumen and tar. The particulate matter can include, but is not limited to the following: oil sands, drilling fluid containing drill cuttings, tailing pond material, crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate.

Analogue ionic liquids herein disclosed include at least two components. The analogue ionic liquids have melting temperatures that are significantly less than the melting temperature of the components making up the analogue ionic liquids. Analogue ionic liquids can include, but are not limited to at least two components selected from the following components: tetralkyl ammonium salts, urea, carboxylic acids, glycerol, metal salts, water, fructose, sucrose, glucose, organic halide salts and organic hydrogen bond donors.

The tetralkyl ammonium salts can include, but are not limited to 2-hydroxyethyl(trimethyl) ammonium chloride (choline chloride), 2-hydroxyethyl(trimethyl) ammonium bromide, 2-hydroxyethyl(triethyl) ammonium chloride, 2-hydroxyethyl(trimethyl) ammonium tetrafluoroborate.

The organic halide salts can include, but are not limited to methyl triphenyl phosphonium bromide.

The organic hydrogen bond donors can include, but are not limited to glycerol, ethylene glycol, or triethylene glycol.

In an exemplary embodiment, the analogue ionic liquid includes choline chloride and urea. In another exemplary embodiment, the analogue ionic liquid includes urea and choline chloride present at a molar ratio of 2:1 urea to choline chloride.

In yet another exemplary embodiment, the analogue ionic liquid includes a concentrated solution of choline chloride in water. In yet another exemplary embodiment, the analogue ionic liquid includes an 80% mixture of choline chloride with 20% water, by weight.

The analogue ionic liquid herein disclosed can be used instead of or in combination with the ionic liquids herein disclosed in any of the exemplary systems or processes described with respect to FIGS. 1-6. The analogue ionic liquid can also be used to separate other particulate matter including, but not limited to the following: oil sands, drilling fluid containing drill cuttings, tailing pond material; crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate. The analogue ionic liquid, water and optionally organic solvent can be mixed with or otherwise placed in contact with the particulate matter to separate or dissociate one or more hydrocarbons from solid particulate for recovery as described with respect to FIGS. 1-6.

EXAMPLES

The following examples are provided to illustrate the exemplary methods for recovering hydrocarbons from particulate matter as herein disclosed. The examples are not intended to limit the scope of the present disclosure and they should not be so interpreted.

In Examples 1-5 and Comparative Example 1, medium-grade Canadian oil sands comprising 10 weight percent bitumen was purchased from the Alberta Research Council and used in separation experiments described below.

Example 1

The ionic liquid 1-butyl-2,3-dimethyl-imidazolium borontetrafluoride was mixed with oil sands at 50° C. A three-phase system was formed. The top phase consisted of bitumen. The middle phase consisted of 1-butyl-2,3-dimethyl-imidazolium borontetrafluoride, suspended minerals and bitumen. The bottom phase consisted of a slurry of 1-butyl-2,3-dimethyl-imidazolium borontetrafluoride, sand and clay.

Figure 7:
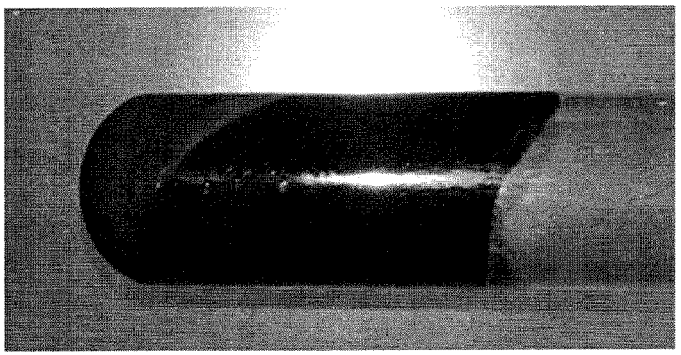
FIG. 7 illustrates an exemplary three-phase system formed from mixing oil sands and ionic liquid according to one embodiment.

FIG. 7 illustrates the three-phase system formed from mixing 1-butyl-2,3-dimethyl-imidazolium borontetrafluoride with oil sands at 50° C. It is a surprising and unexpected result that a highly polar ionic liquid that is immiscible with non-polar hydrocarbons, such as bitumen, toluene and naphtha would be suitable for separating bitumen from sand. It is also unexpected that 1-butyl-2,3-dimethyl-imidazolium borontetrafluoride would separate bitumen from sand at a low temperature of 50° C. or less. It was also observed that a two-phase mixture including a viscous top layer and bottom layer is formed when relatively smaller amounts of ionic liquid are used. The viscous top layer of the two-phase system consisted of bitumen and the bottom layer consisted of ionic liquid, suspended mineral particles and residual bitumen.

Comparative Example 1

Figure 8:
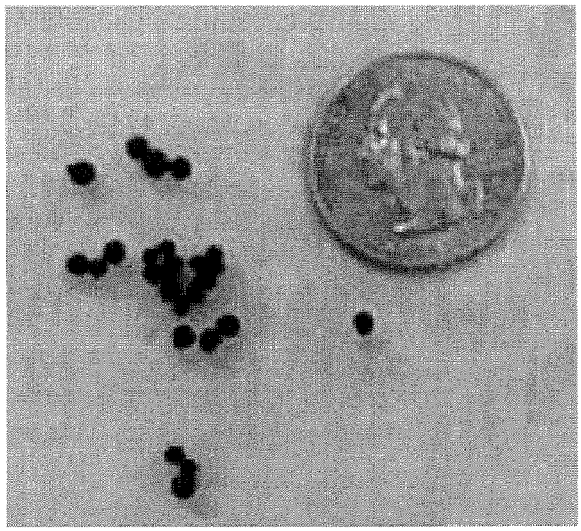
FIG. 8 illustrates a comparative example of bitumen encrusted minerals.

The ionic liquid 1-butyl-3-methyl imidazolium trifluoromethanesulfonate was mixed with oil sands. The ionic liquid did not separate bitumen from the oil sands, but instead resulted in the formation of agglomerated, spherical, black balls of bitumen-encrusted minerals illustrated in FIG. 8. However, as illustrated in Examples 4 and 6, when an organic solvent is added in combination with 1-butyl-3-methyl imidazolium trifluoro-methanesulfonate a clean separation of bitumen from oil sands is unexpectedly achieved.

Example 2

Figure 9:
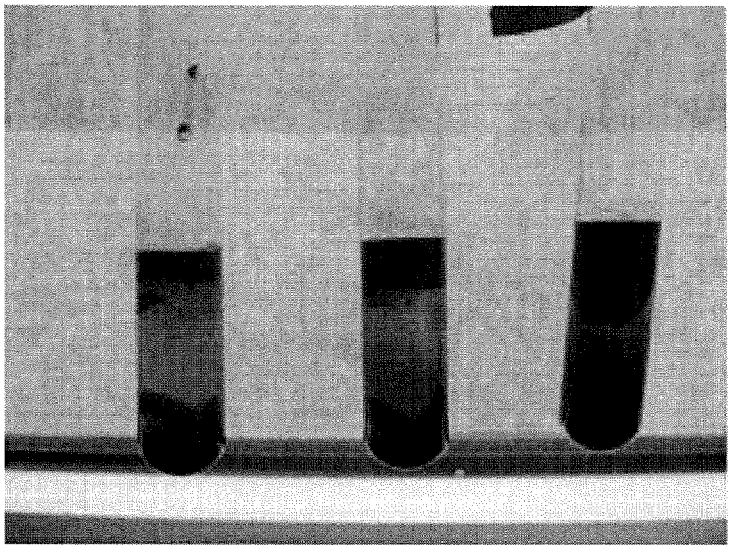
FIG. 9 illustrates exemplary three-phase systems formed from mixing oil sands, ionic liquid and organic solvent according to one embodiment.

A composition of 50 weight percent of the ionic liquid 1-butyl-2,3-dimethyl-imidazolium borontetrafluoride, 33.3 weight percent toluene and 16.7 weight percent oil sands was mixed at temperatures between 50° C. and 60° C. A three-phase system was formed and a clean separation of bitumen from oil sands was unexpectedly achieved. The top phase consisted of toluene and bitumen. The middle phase consisted of 1-butyl-2,3-dimethyl-imidazolium borontetrafluoride with small amounts of dissolved and/or suspended bitumen particles and mineral fines. The bottom phase consisted of 1-butyl-2,3-dimethyl-imidazolium borontetrafluoride with suspended sand and clay. FIG. 9 illustrates the three-phase system (in the right vial) formed from mixing 50 weight percent 1-butyl-2,3-dimethyl-imidazolium borontetrafluoride, 33.3 weight percent toluene and 16.7 weight percent oil sands.

The top phase was removed using a pipette. The toluene was evaporated from the top phase. Upon evaporation of the toluene from the top phase, a residual amount of 1-butyl-2,3-dimethyl-imidazolium borontetrafluoride that was entrained during the separation process remained in the vial below the bitumen phase. Toluene was added to the vial containing the 1-butyl-2,3-dimethyl-imidazolium borontetrafluoride and bitumen and the resulting toluene/bitumen phase was decanted. Due to its high viscosity, the 1-butyl-2,3-dimethyl-imidazolium borontetrafluoride remained at the bottom of the vial while pouring the toluene/bitumen phase into a new vial to achieve a clean separation. The bitumen was recovered after evaporating the toluene. The recovered bitumen comprised about 12-13 weight percent of the original oil sands. The 1-butyl-2,3-dimethyl-imidazolium borontetrafluoride in the middle phase was separated from the sand and clay by adding water to the middle phase and filtering. The water is easily removed from the ionic liquid/water solution by evaporation or any other standard method of liquid-liquid separation.

Example 3

A composition of 50 weight percent of the ionic liquid 1-butyl-2,3-dimethyl-imidazolium trifluoro-methanesulfonate, 33.3 weight percent toluene and 16.7 weight percent oil sands was mixed at temperatures between 50° C. and 60° C. A three-phase system was formed and a clean separation of bitumen from oil sands was unexpectedly achieved. The top phase consisted of toluene and bitumen. The middle phase consisted of 1-butyl-2,3-dimethyl-imidazolium trifluoro-methanesulfonate with small amounts of dissolved and/or suspended bitumen particles and mineral fines. The bottom phase consisted of 1-butyl-2,3-dimethyl-imidazolium trifluoro-methanesulfonate with suspended sand and clay. FIG. 9 illustrates the three-phase system (in the middle vial) formed from mixing 50 weight percent of the ionic liquid 1-butyl-2,3-dimethyl-imidazolium trifluoro-methanesulfonate, 33.3 weight percent toluene and 16.7 weight percent oil sands.

The top phase was removed using a pipette. The toluene was evaporated from the top phase. Upon evaporation of the toluene from the top phase, a residual amount of 1-butyl-2,3-dimethyl-imidazolium trifluoro-methanesulfonate that was entrained during the separation process remained in the vial below the bitumen phase. Toluene was added to the vial containing the 1-butyl-2,3-dimethyl-imidazolium trifluoro-methanesulfonate and bitumen and the resulting toluene/bitumen phase was decanted. Due to its high viscosity, the 1-butyl-2,3-dimethyl-imidazolium trifluoro-methanesulfonate remained at the bottom of the vial while pouring the toluene/bitumen phase into a new vial to achieve a clean separation. The bitumen was recovered after evaporating the toluene. The recovered bitumen comprised about 12-13 weight percent of the original oil sands. The 1-butyl-2,3-dimethyl-imidazolium trifluoro-methanesulfonate in the middle phase was separated from the sand and clay by adding water to the middle phase and filtering. The water is easily removed from the ionic liquid/water solution by evaporation or any other standard method of liquid-liquid separation.

Example 4

A composition of 50 weight percent of the ionic liquid 1-butyl-3-methyl-imidazolium trifluoromethanesulfonate, 33.3 weight percent toluene and 16.7 weight percent oil sands was mixed at temperatures between 50° C. and 60° C. A three-phase system was formed and a clean separation of bitumen from oil sands was unexpectedly achieved. The top phase consisted of toluene and bitumen. The middle phase consisted of 1-butyl-3-methyl-imidazolium trifluoromethanesulfonate with small amounts of dissolved and or suspended bitumen particles and mineral fines. The bottom phase consisted of 1-butyl-3-methyl-imidazolium trifluoromethanesulfonate with suspended sand and clay. FIG. 9 illustrates the three-phase system (in the left vial) formed from mixing 50 weight percent of the ionic liquid 1-butyl-3-methyl-imidazolium trifluoromethanesulfonate, 33.3 weight percent toluene and 16.7 weight percent oil sands.

The top phase was removed using a pipette. The toluene was evaporated from the top phase. Upon evaporation of the toluene from the top phase, a residual amount of 1-butyl-3-methyl-imidazolium trifluoromethanesulfonate that was entrained during the separation process remained in the vial below the bitumen phase. Toluene was added to the vial containing 1-butyl-3-methyl-imidazolium trifluoromethanesulfonate and bitumen and the resulting toluene/bitumen phase was decanted. Due to its high viscosity, the 1-butyl-3-methyl-imidazolium trifluoromethanesulfonate remained at the bottom of the vial while pouring the toluene/bitumen phase into a new vial to achieve a clean separation. The bitumen was recovered after evaporating the toluene. The recovered bitumen comprised about 12-13 weight percent of the original oil sands. The 1-butyl-3-methyl-imidazolium trifluoromethanesulfonate in the middle phase was separated from the sand and clay by adding water to the middle phase and filtering. The water is easily removed from the ionic liquid/water solution by evaporation or any other standard method of liquid-liquid separation.

Figure 10:
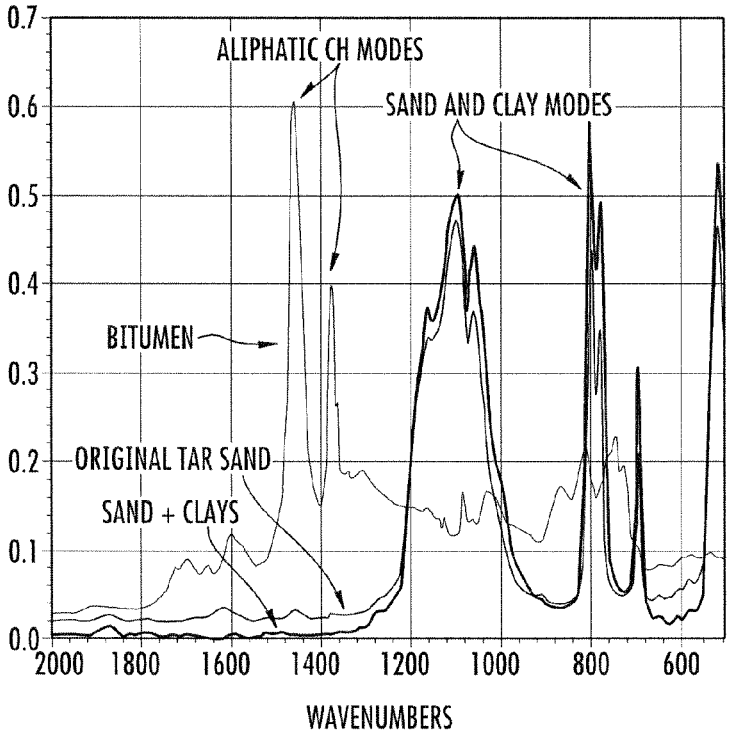
FIG. 10 illustrates an exemplary infrared spectra of medium grade Canadian oil sands and component parts thereof before and after separation of bitumen.

FIG. 10 illustrates infrared spectra of medium-grade Canadian oil sands and component parts thereof before and after separation of bitumen. Upon evaporation of the second addition of toluene in Examples 2-4, the original oil sands sample, the recovered bitumen and the separated sand/clay were analyzed using infrared spectrometry. Bands due to methylene and methyl groups near 1450 $cm^{-1}$ and 1370 $cm^{-1}$ are prominent in the spectrum of the bitumen, and appear with very weak intensity in the spectrum of the oil sands. The mineral bands (predominantly quartz and clay) near 1100 $cm^{-1}$, 800 $cm^{-1}$ and 500 $cm^{-1}$ absorb very strongly in the infrared and mask bands due to organic groups. However, these hydrocarbon absorption modes are essentially undetectable in the spectrum of the sand/clay mixture recovered from the bottom phase, even in scale-expanded spectra. Similarly, the mineral bands are absent from the spectrum of the bitumen. This is most easily seen by examining the right hand end of the plots, near 500 $cm^{-1}$. This demonstrates that the bitumen was separated from the oil sands without carrying over fine particles, unlike the hot or warm water processes presently used in the prior art. In Examples 1-4, a bitumen yield in excess of 90 percent was achieved.

Example 5

A composition of 50 weight percent of the ionic liquid 1-butyl-2,3-dimethyl-imidazolium borontetrafluoride, 33.3 weight percent toluene and 16.7 weight percent oil sands was mixed at a temperatures of 25° C. A three-phase system was formed and a clean separation of bitumen from oil sands was unexpectedly achieved. The top phase consisted of toluene and bitumen. The middle phase consisted of 1-butyl-2,3-dimethyl-imidazolium borontetrafluoride with small amounts of dissolved and/or suspended bitumen particles and mineral fines. The bottom phase consisted of 1-butyl-2,3-dimethyl-imidazolium borontetrafluoride with suspended sand and clay.

The top phase was removed using a pipette. The toluene was evaporated from the top phase. Upon evaporation of the toluene from the top phase, a residual amount of 1-butyl-2,3-dimethyl-imidazolium borontetrafluoride that was entrained during the separation process remained in the vial below the bitumen phase. Toluene was added to the vial containing the 1-butyl-2,3-dimethyl-imidazolium borontetrafluoride and bitumen and the resulting toluene/bitumen phase was decanted. Due to its high viscosity, the 1-butyl-2,3-dimethyl-imidazolium borontetrafluoride remained at the bottom of the vial while pouring the toluene/bitumen phase into a new vial to achieve a clean separation. The bitumen was recovered after evaporating the toluene. The recovered bitumen comprised about 12-13 weight percent of the original oil sands. The 1-butyl-2,3-dimethyl-imidazolium borontetrafluoride in the middle phase was separated from the sand and clay by adding water to the middle phase and filtering. The water is easily removed from the ionic liquid/water solution by evaporation or any other standard method of liquid-liquid separation.

Examples 1-5 involve the separation of bitumen from medium-grade oil sands. No detectable mineral fines were recovered with the bitumen in Examples 1-5. Bitumen in low-grade oil sand feedstock is more difficult to recover free of mineral fine. The prior art warm water separation processes leave a significant amount of mineral fines in the separated and recovered bitumen, which leads to subsequent processing problems and reduces the economic viability of the process. The separation and recovering of bitumen with the use of the exemplary systems, methods and ionic liquids herein disclosed left no detectable mineral fines at separation temperatures below 100° C., preferably below 50° C. and more preferably at temperatures of 25° C. and lower.

Example 6

Examples 1-5 were also conducted at mixing ratios of 25 weight percent ionic liquid, 50 weight percent organic solvent and 25 weight percent low-grade oil sands at a temperature of 25° C. and lower. A three-phase separation of low grade oil sands and yields of bitumen in excess of 90 percent were unexpectedly achieved.

Figure 11:
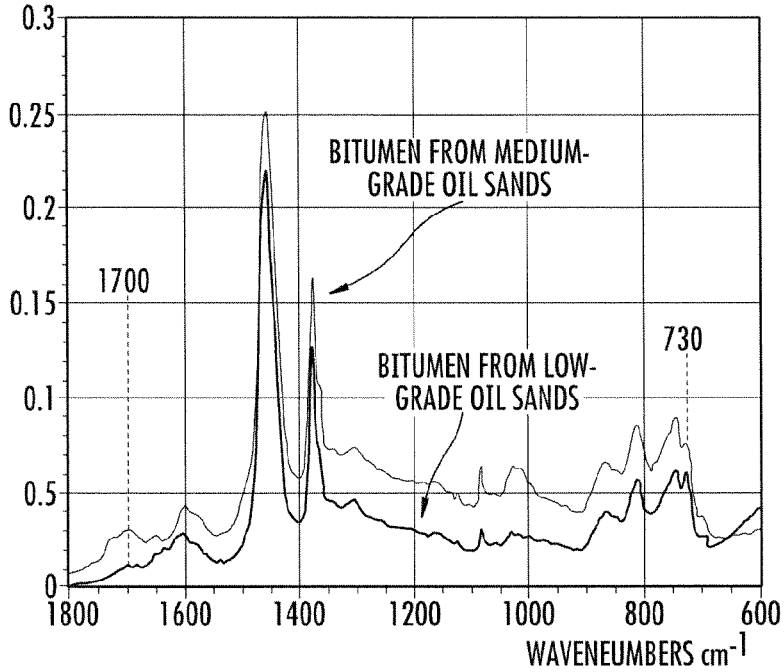
FIG. 11 illustrates an exemplary infrared spectra of low-grade oil sands and medium-grade oil sands after separation of bitumen.

FIG. 11 illustrates the infrared spectra of low-grade oil sands and medium-grade oil sands after separation of bitumen at 25° C. using the mixing ratio of Example 6. Strong infrared absorption bands due to minerals near 1000 $cm^{-1}$ cannot be detected in the low-grade oil sands spectra or the medium-grade oil sands spectra. It was surprisingly found that low-grade oil sands can be separated to produce bitumen free of mineral fines at low temperatures (e.g., 25° C. and lower) using the systems, methods and ionic liquids herein disclosed.

In Examples 1-6, a separation of bitumen from both medium-grade and low-grade oil sands was achieved without the use of water in the primary separation step. Some water was used in Examples 1-6 to remove ionic liquid from sand, but as disclosed herein, the water can be separated and recycled through the system with substantially no loss. In some circumstances, the particulate matter including hydrocarbons and solid particulate is mixed with significant quantities of water to transport or pump the particulate matter. For example, in some oil sands mining operations, water is used to transport the mixture as slurry to a processing plant. With the use of the systems, methods and compositions herein disclosed the water does not have to be removed prior to separation of hydrocarbon from the solid particulate.

Examples 7-8 are provided to illustrate exemplary methods for recovering bitumen from low-grade and medium-grade Canadian oils sands with the use of water in the primary separation step. The examples are not intended to limit the scope of the present disclosure and they should not be so interpreted.

Example 7

A separating composition of 50 weight percent of the ionic liquid 1-butyl-2,3-dimethyl-imidazolium borontetrafluoride and 50 weight percent water was created. 2 grams of the separating composition and 3 grams of toluene were mixed respectively with 1 gram of low-grade oil sands and 1 gram of medium-grade oil sands in two separate experiments at a temperature of 25° C. The separating composition created a three phase system when mixed with low-grade oil sands and medium-grade oil sands.

Figure 12:
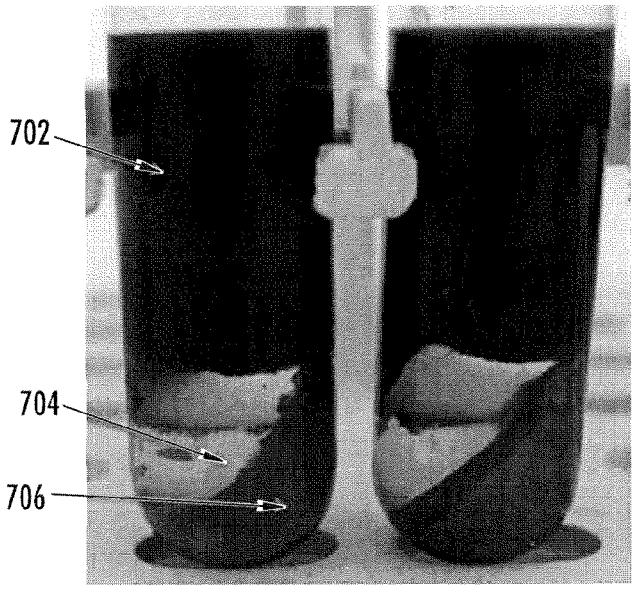
FIG. 12 illustrates exemplary three-phase systems formed from mixing an exemplary separating composition and toluene with low-grade and medium-grade oil sands according to one embodiment.

FIG. 12 illustrates exemplary three-phase systems formed from mixing the separating composition of Example 7 and toluene with low-grade and medium-grade oil sands. The vial on the left of in FIG. 12 illustrates a three phase system formed from separating low-grade oil sands and the vial on the right illustrates a three phase system formed from separating medium-grade oil sands. The bottom phase 706 of the vials contains a slurry of ionic liquid, water and sand. The middle phase 704 of the vials contains ionic liquid, water and small amounts of mineral fines. The top phase 702 of the vials contains a dark organic layer of bitumen dissolved in toluene. The top phase of the vials was separated using a pipette. Toluene was then evaporated from the bitumen in the top phase in a vacuum oven. A yield of 3.6 percent bitumen was achieved in low-grade oil sands using the separating composition of Example 7. A yield of 14.6 percent bitumen was achieved in medium-grade oil sands using the separating composition of Example 7.

Example 8

A separating composition of 25 weight percent of the ionic liquid 1-butyl-2,3-dimethyl-imidazolium borontetrafluoride and 75 weight percent water was created. 2 grams of the separating composition was mixed with 3 grams of toluene and 1 gram of low-grade oil sands at a temperature of 25° C. The separating composition created a three phase system when mixed with low-grade oil sands. The bottom phase contained a slurry of ionic liquid, water and sand. The middle phase contained ionic liquid, water and small amounts of mineral fines. The top phase contained a dark organic layer of bitumen dissolved in toluene. The top phase was separated using a pipette. Toluene was then evaporated from the bitumen in the top phase in a vacuum oven. A yield of 5.1 percent bitumen was achieved in low-grade oil sands using the separating composition of Example 8.

Figure 13:
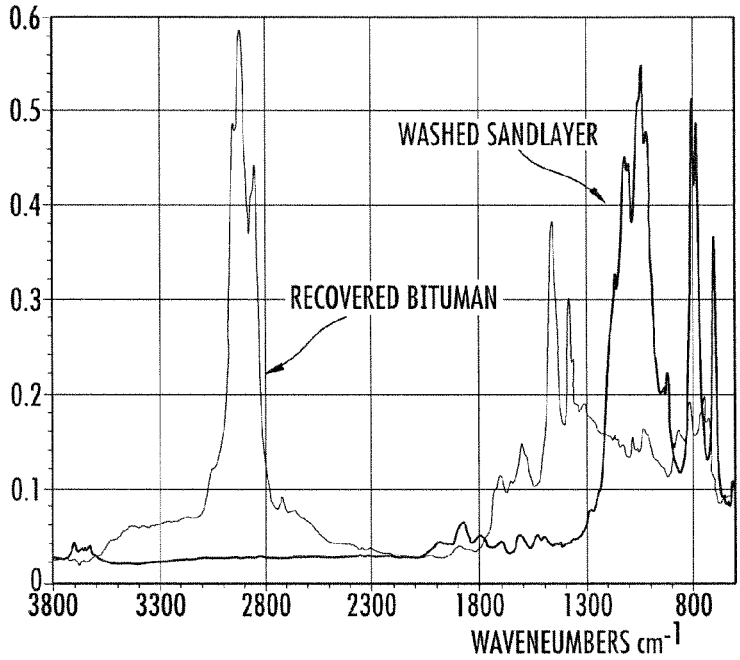
FIG. 13 illustrates the infrared spectra of extracted bitumen and residual sand obtained in the separation of low-grade oil sands using an exemplary separating composition according to one embodiment.

FIG. 13 illustrates the infrared spectra of extracted bitumen and residual sand obtained in the separation of low-grade oil sands using the separating composition of Example 8. It was surprisingly found that bitumen bands between 2800 $cm^{-1}$ and 3000 $cm^{-1}$ are absent in the spectrum of the residual materials and mineral bands between 1000 $cm^{-1}$ and 800 $cm^{-1}$ are absent in the spectrum of bitumen. Therefore, a clean separation of low-grade oil sands with no residual sand in separated bitumen and no residual bitumen in separated sand was achieved.

The Canadian oil sands that were separated in Examples 1-8 were unconsolidated samples of oil sands. Utah oil sands are consolidated rock-like formations that cannot be processed directly with the prior art warm water processes presently used for unconsolidated oil sands. Example 9 is provided to illustrate the effectiveness of the systems, methods and compositions herein disclosed in separating consolidated Utah oil sands. The example is not intended to limit the scope of the present disclosure and should not be so interpreted.

Example 9

A composition of 33.3 weight percent of the ionic liquid 1-butyl-2,3-dimethyl-imidazolium borontetrafluoride, 50.0 weight percent toluene and 16.7 weight percent consolidated Utah oil sands was mixed at a temperatures of 25° C. A three-phase system was formed and a clean separation of bitumen from oil sands was unexpectedly achieved. The top phase consisted of toluene and bitumen. The middle phase consisted of 1-butyl-2,3-dimethyl-imidazolium borontetrafluoride with small amounts of dissolved and/or suspended bitumen particles and mineral fines. The bottom phase consisted of 1-butyl-2,3-dimethyl-imidazolium borontetrafluoride with suspended sand and clay. The top phase was removed using a pipette. The toluene was evaporated from the top phase. The bitumen was recovered after evaporating the toluene. A yield of over 90 percent bitumen from the original sample of oil sands was obtained with no detectable mineral fines in the bitumen.

Example 10

In this example, the ionic liquid 1-butyl-2,3-dimethyl-imidazolium borontetrafluoride, and toluene were used to separate oil from sand in a contaminated sand sample. The ionic liquid 1-butyl-2,3-dimethyl-imidazolium borontetrafluoride, toluene and the contaminated sand sample were mixed in the proportions 1:2:3 by weight respectively at 25° C. to achieve three phase separation. Other proportions can also be used to achieve three phase separation.

Figure 14:
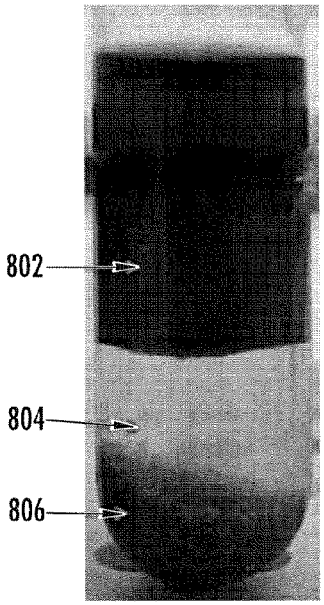
FIG. 14 illustrates an exemplary three-phase system formed from mixing ionic liquid, organic solvent and contaminated sand according to one embodiment.

FIG. 14 illustrates an exemplary three-phase system formed from mixing ionic liquid (e.g., 1-butyl-2,3-dimethyl-imidazolium borontetrafluoride), organic solvent (e.g., toluene) and contaminated sand according to Example 10. The top phase 802 contained oil and toluene. The middle phase 804 contained ionic liquid, residual mounts of oil and mineral fines. The bottom phase 806 contained ionic liquid and sand.

The three phases are easily separated in the laboratory using a pipette as described in the previous examples. Any inadvertent entraining of one phase in another can be alleviated by washing the phase with water or a non-polar solvent (e.g., toluene) depending on the phase which requires purification. The toluene is readily removed from the top phase through distillation. It is important to note, that the top phase containing oil and toluene contained no detectable mineral fines. The ionic liquid in the bottom phase was removed by washing with water. The sand in the bottom phase contained no detectable toluene or oil contamination after the ionic liquid was removed.

Example 11

In this example, ionic liquid 1-butyl-2,3-dimethyl-imidazolium borontetrafluoride, and toluene were used to separate oil from drill cuttings in a contaminated drill cuttings sample. The ionic liquid 1-butyl-2,3-dimethyl-imidazolium borontetrafluoride, toluene and the contaminated drill cuttings were mixed at 25° C. to achieve three phase separation. The top phase contained oil and toluene. The middle phase contained ionic liquid, residual mounts of oil, residual mineral fines and residual drill cuttings. The bottom phase contained ionic liquid and drill cuttings.

The three phases are easily separated in the laboratory using a pipette as described in the previous examples. Any inadvertent entraining of one phase in another can be alleviated by washing the phase with water or a non-polar solvent (e.g., toluene) depending on the phase. The toluene in the top phase is removed through distillation. The ionic liquid in the bottom phase was removed by washing with water.

Figure 15:
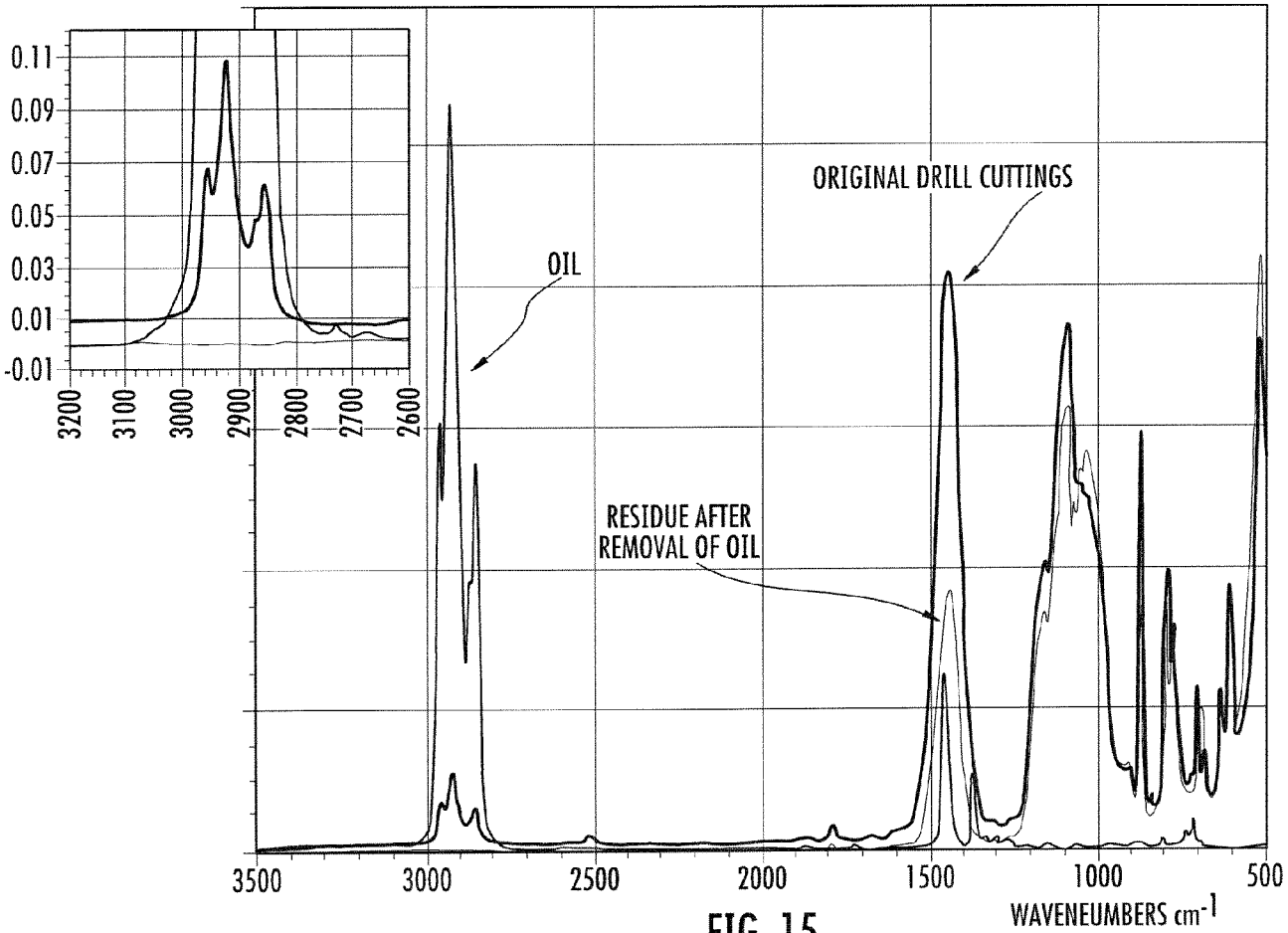
FIG. 15 illustrates the infrared spectra of contaminated drill cuttings and component parts thereof before and after separation of oil.

FIG. 15 illustrates infrared spectra of the original contaminated drill cuttings, oil after separation and material after removal of oil in Example 11. The spectrum of the original drill cuttings is dominated by silicate (sand) absorption between 1000 and 1100 $cm^{-1}$. There is also a strong absorption due to carbonates near 1450 $cm^{-1}$, similar to what is observed in the spectrum of chalk. Minerals absorb infrared radiation far more strongly than oil, but only weakly absorbing modes between 2800 and 3000 $cm^{-1}$ are observed. An absorption scale-expanded insert, which reveals the bands due to the oil in the spectrum of the drill cuttings, is also illustrated in FIG. 15. However, these absorptions are absent from the spectrum of the residual materials after removal of oil. Therefore, the residual materials including drill cuttings are free from oil contamination. It can also be seen from the spectrum of oil, that the oil was recovered free of minerals and drill cuttings.

Example 12

In this example, samples in the form of tar balls were obtained from a beach in the Gulf of Mexico after the Deepwater Horizon oil spill. Tar ball samples were mixed with various separation solutions to effect separation. One exemplary separation solution contained the ionic liquid 1-ethyl-3-methyl-imidazolium chloride, water and toluene. A comparative separation solution included water and toluene only. In the experiments where ionic liquid and water were used in the separation solution, 1-part by weight tar balls were mixed with 2-parts by weight ethyl-3-methyl-imidazolium chloride and water and 1-part by weight toluene. Both separation solutions were mixed with tar balls and stirred at a temperature of 20° C. The degree of phase separation strongly depended on the concentration of the ionic liquid 1-ethyl-3-methyl-imidazolium chloride in the separation solution.

Figure 16:
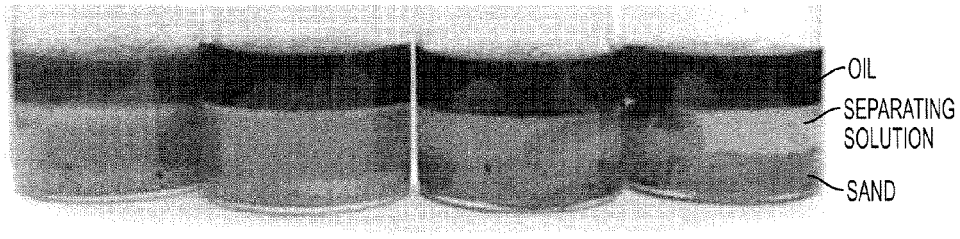
FIG. 16 illustrates exemplary and comparative multi-phase systems formed from mixing exemplary and comparative separation solutions with tar balls according to one embodiment.

FIG. 16 illustrates exemplary and comparative multi-phase systems formed from mixing both separation solutions with tar balls according to Example 12. The vial on the far left illustrated in FIG. 16 is a four phase system formed from mixing tar balls with the comparative separation solution containing water and toluene. The other three vials illustrated in FIG. 16 are multi-phase systems formed from mixing tar balls with the exemplary separation solution containing 25% by weight 1-ethyl-3-methyl-imidazolium chloride, 50% by weight 1-ethyl-3-methyl-imidazolium chloride and 75% by weight 1-ethyl-3-methyl-imidazolium chloride respectively from left to right.

The four phase system (far left vial of FIG. 16) formed from mixing tar balls with the comparative separation solution included a top hydrocarbon phase appearing lighter than the top phase in the other multi-phase systems. The lighter top hydrocarbon phase is due to suspended sand particles in the top phase of the far left vial. Similarly the middle water phase of the far left vial is murky in appearance due to the presence of sand in the form of fine particles. A thin white phase of material separating the hydrocarbon phase and water phase is also present. An infrared spectrum of the thin white phase showed that the phase contains some proteins and polysaccharides potentially from seaweed and/or other biological matter from sea water.

The exemplary four phase system ($2^{nd}$ vial from the left of FIG. 16) formed from mixing tar balls with separation solution containing 25% by weight 1-ethyl-3-methyl-imidazolium chloride produced a better separation. The top hydrocarbon phase was much darker than the far left vial indicating a higher degree of tar separation. The top hydrocarbon phase contained a small amount of sand. The middle phase containing 1-ethyl-3-methyl-imidazolium chloride and water remained murky due to the presence of suspended minerals. There remained a thin white layer containing biopolymers separating the top hydrocarbon phase from the middle phase containing 1-ethyl-3-methyl-imidazolium chloride and water.

The exemplary three-phase systems (3$^{rd}$ vial from the left and far right vial of FIG. 16) formed from mixing tar balls with separation solutions containing 50% and 75% by weight 1-ethyl-3-methyl-imidazolium chloride produced even more pronounced phase separation. The middle phase of ionic liquid and water in the vials were clear and substantially free of sand. Visual examination of the bottom sand phase also indicates a more pronounced phase separation substantially free of tar when separation solutions containing greater than or equal to 50% by weight 1-ethyl-3-methyl-imidazolium chloride are used. Furthermore, three phase systems (e.g., 3$^{rd}$ vial from the left and far right vial of FIG. 16) formed from mixing tar balls with separation solutions containing greater than or equal to 50% by weight 1-ethyl-3-methyl-imidazolium chloride no longer contained a biomaterial phase separating the top hydrocarbon phase from the middle phase of ionic liquid and water. Infrared spectroscopy indicated that the bottom sand phase contained no detectable residual tar and the recovered tar from the top phase contained only trace amounts of minerals. Therefore, higher concentrations of ionic liquid are necessary for sufficient phase separation in Example 12.

Figure 17:
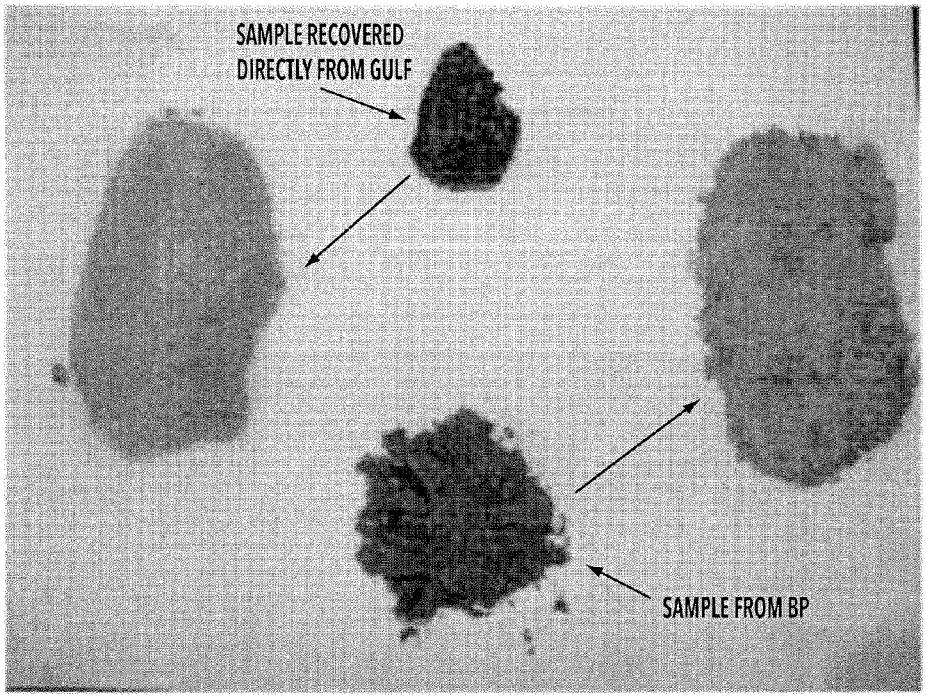
FIG. 17 illustrates tar contaminated sand prior to separation and sand free of tar contamination after separation with the use of an exemplary ionic liquid.

FIG. 17 illustrates tar contaminated sand prior to separation and sand free of tar contamination after separation with the use an exemplary ionic liquid according to Example 12. The uncontaminated sand appears clean after separation of hydrocarbons such as tar when exemplary ionic liquids of Example 12 are used to effect separation.

Comparative Example 2

Figure 18:
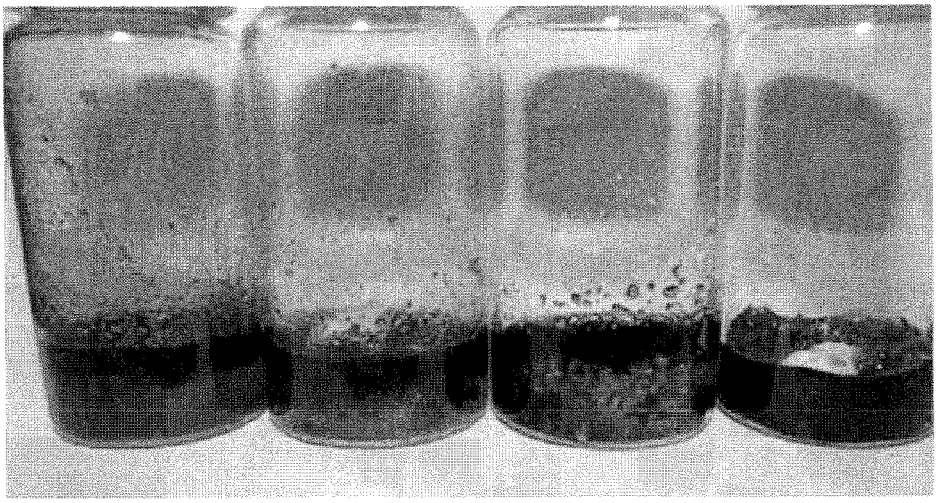
FIG. 18 illustrates comparative systems formed from mixing Canadian tar sands with comparative additive solutions.

In this example, comparative additives and a comparative separation process was used to separate bitumen from Canadian tar sands. Additive solutions containing 0%, 25%, 50% and 75% by weight acrylamide/sodium acrylate acid copolymer (hydrolyzed polyacrylamide) in water were prepared. 2 parts by weight additive solution was mixed with 1 part by weight toluene and 1 part by weight Canadian tar sands at room temperature. High molecular weight polymers or copolymers such as, hydrolyzed polyacrylamide form thick, viscous gels at high concentrations in solution due to chain entanglements. As shown in FIG. 18, aqueous solutions of the polyacrylamide copolymer were no exception.

FIG. 18 illustrates comparative systems formed from mixing Canadian tar sands with additive solutions and toluene according to Comparative Example 2. Additive solutions containing 0%, 25%, 50% and 75% by weight acrylamide/sodium acrylate acid copolymer (hydrolyzed polyacrylamide) in water were used in the vials in FIG. 18 from left to right respectively. Unlike the results obtained with ionic liquids, segregation into easily separated phases did not occur at any concentration. Polyacrylamide copolymers did not result in the type of facile phase separations observed with ionic liquids.

Comparative Example 3

In this example, a comparative additives and a comparative separation process was used to separation bitumen from Canadian tar sands. Additive solutions containing 0%, 25%, 50% and 75% by weight polyacrylic acid in water were prepared. 2 parts by weight additive solution was mixed with 1 part by weight toluene and 1 part by weight Canadian tar sands at room temperature.

Figure 19:
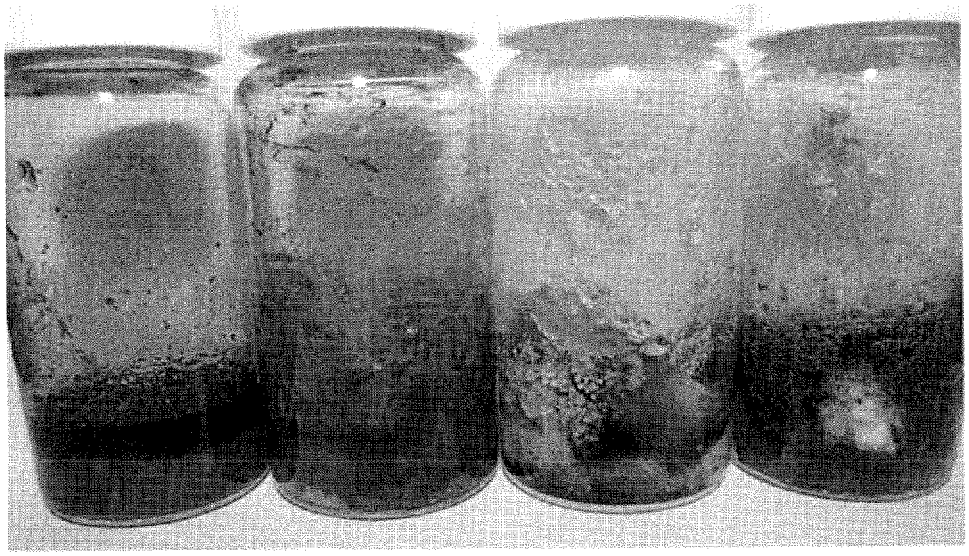
FIG. 19 illustrates comparative systems formed from mixing Canadian tar sands with other comparative additive solutions.

FIG. 19 illustrates comparative systems formed from mixing Canadian tar sands with additive solutions and toluene according to Comparative Example 3. Additive solutions containing 0%, 25%, 50% and 75% by weight polyacrylic acid in water were used in the vials in FIG. 19 from left to right respectively. Conglomerations of polymer gel were observed on the sides of the vials. Unlike the results obtained with ionic liquids, segregation into easily separated phases did not occur at any concentration.

Comparative Example 4

In this example, a comparative additive and separation process was used to separation bitumen from Canadian tar sands. An additive solution containing 75% by weight citric acid in water was prepared. 2 parts by weight additive solution was mixed with 1 part by weight toluene and 1 part by weight Canadian tar sands at room temperature.

Figure 20:
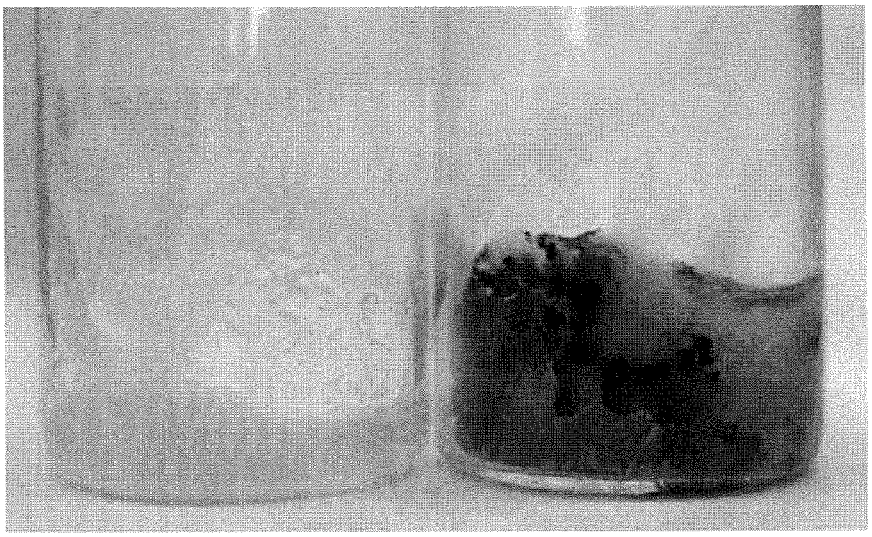
FIG. 20 illustrates a comparative system formed from mixing Canadian tar sands with another comparative additive solution.

FIG. 20 illustrates a comparative system formed from mixing Canadian tar sands with the additive solution and toluene according to Comparative Example 3. The vial on the left shown in FIG. 20 illustrates the additive solution containing 75% by weight citric acid in water. Concentrated aqueous solutions of low molecular weight additives such as citric acid do not gel in the same way as polymers, but at high concentrations citric acid does not completely dissolve in water. The vial on the right in FIG. 20 illustrates the system formed from mixing 2 parts by weight additive solution (containing 75% by weight citric acid in water) with 1 part by weight toluene and 1 part by weight Canadian tar sands at room temperature. High concentrations of citric acid (greater than or equal to 25% by weight in water) did not result in the type of facile separations observed with the use of concentrated ionic liquid solutions.

At low concentrations (parts per million), citric acid, polyacrylamide and other additives disclosed herein aid separation by sequestering ions present in tar sands that act to attach mineral fines to bitumen. The surprising phase separations observed when using concentrated ionic liquid separation solutions disclosed herein is facilitated by a significant reduction in adhesion between silica (sand) or other mineral particles and the hydrocarbon to be separated.

Example 13

In this example, an analogue ionic liquid of choline chloride and urea was prepared by mixing urea and choline chloride in the weight ratio of 1.2 to 1.4 respectively (2:1 molar ratio). This mixture of powders was placed in a vial and heated to about 80° C. whereupon a liquid was formed. Upon cooling to room temperature, the mixture remained a liquid but was very viscous. The liquid (1 part by weight) was mixed with Canadian tar sands (1 part by weight) and toluene (1 part by weight) and stirred in a laboratory vial at room temperature. Although a degree of phase separation occurred after a few minutes, with a top hydrocarbon phase present in the vial, a separation into easily distinguishable phases was not achieved under these conditions.

Figure 21:
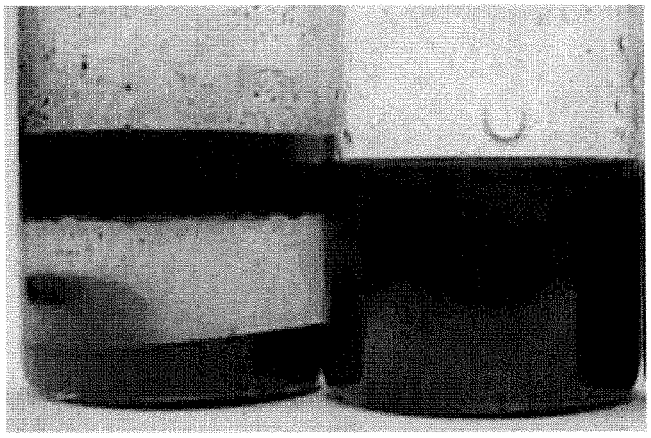
FIG. 21 illustrates an exemplary multi-phase system formed from mixing Canadian tar sands with an exemplary analogue ionic liquid according to one embodiment.

FIG. 21 illustrates an exemplary multi-phase system formed from mixing Canadian tar sands with an exemplary analogue ionic liquid according to Example 13. As shown in the right vial in FIG. 21, the vial appears almost uniformly black due to the viscous nature of the analogue ionic liquid.

The high viscosity hindered separation under the action of density differences and gravity alone. A separation was achieved after centrifugation. Alternatively, when a mixture of the exemplary analogue ionic liquid of Example 13 was diluted with water (1:1 by weight) to lower the viscosity of the mixture, a separation into three phases was achieved shown in the left vial of FIG. 21. This result was surprising, because as demonstrated in Comparative Example 2, concentrated solutions of other common salts or materials used in current extraction processes do not result in a separation.

Example 14

In this example, an analogue ionic liquid of choline chloride and urea was prepared by mixing urea and choline chloride in the weight ratio of 1.2 to 1.4 (2:1 molar ratio) and diluting with 0.33 parts by weight water. The analogue ionic liquid and water were mixed with 1 part by weight Canadian tar sands and 1 part by weight toluene. The mixture was stirred for about 1 minute and left to stand for 15 minutes.

Figure 22:
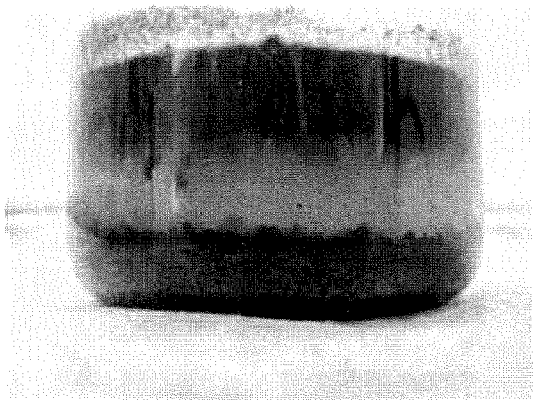
FIG. 22 illustrates an exemplary multi-phase system formed from mixing Canadian tar sands with an exemplary analogue ionic liquid according to another embodiment.

FIG. 22 illustrates an exemplary multi-phase system formed from mixing Canadian tar sands with an exemplary analogue ionic liquid according to Example 14. A partial separation into three phases was achieved under the action of density differences and gravity alone. To speed the process, the top phase and about half of the middle (cloudy) phase was decanted and placed in one centrifuge tube. The bottom mineral phase together with the other half of the middle phase was placed in a second centrifuge tube. The liquids were centrifuged for 15 minutes at 3000 rpm.

Figure 23:
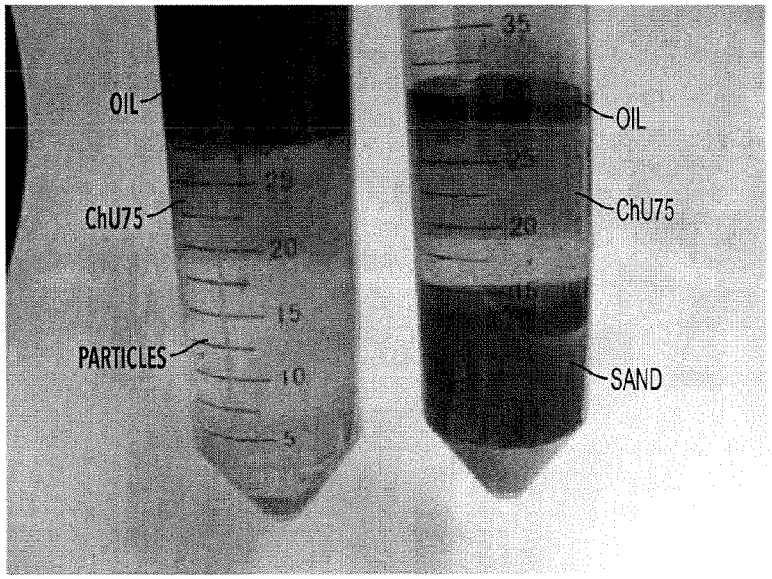
FIG. 23 illustrates exemplary three-phase systems formed from centrifuging components of the exemplary multi-phase system shown in FIG. 22.

FIG. 23 illustrates exemplary three phase systems formed from centrifuging components of the exemplary multi-phase system shown in FIG. 22. Centrifugation of top phase with ½ middle phase (left vial) and the bottom phase with ½ middle phase (right vial) resulted in a pronounced three phase separation having a top hydrocarbon phase, a middle analogue ionic liquid with water phase and a bottom mineral phase shown in FIG. 23. The hydrocarbon phase was removed using a pipette and a film was cast for infrared analysis. The mineral phase was washed with water to remove any entrained analogue ionic liquid and a small amount of the dried sample was also analyzed by infrared spectroscopy.

Figure 24:
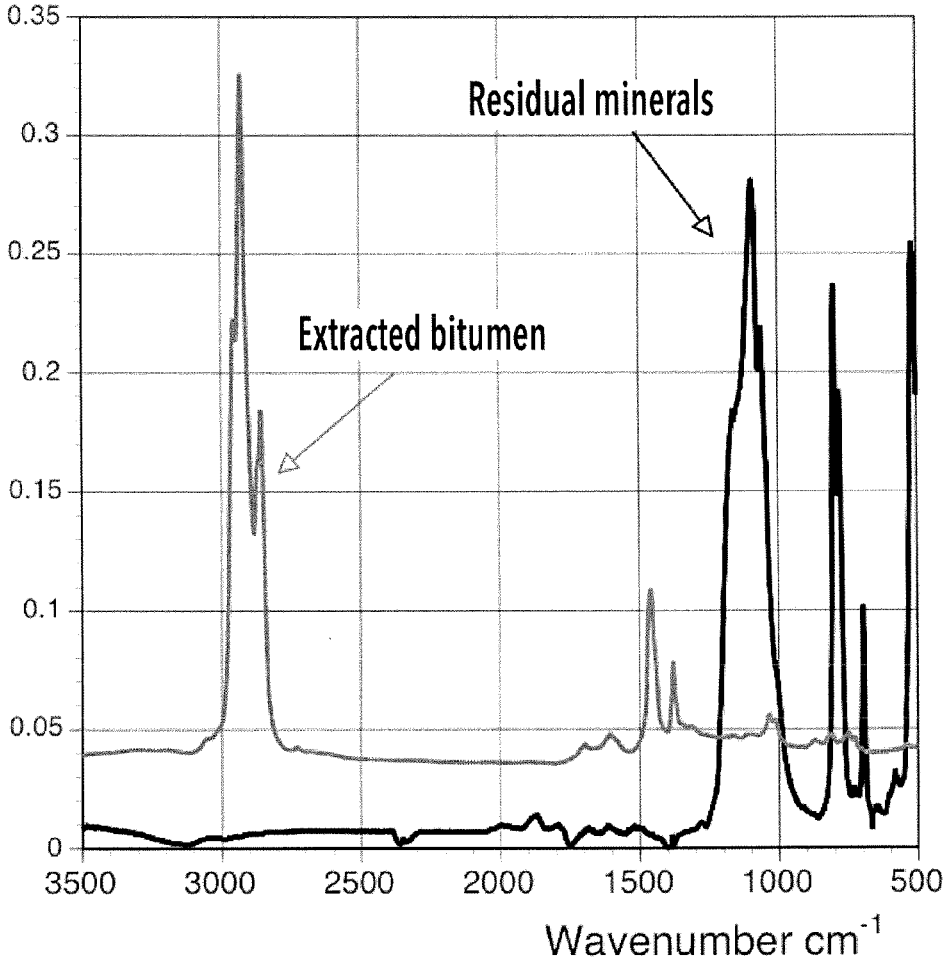
FIG. 24 illustrates infra red spectra of the top hydrocarbon phase and the bottom mineral phase of the exemplary three-phase systems shown in FIG. 23.

FIG. 24 illustrates infra red spectra of the top hydrocarbon phase and the bottom mineral phase of the exemplary three-phase systems shown in FIG. 23. The spectrum of the top hydrocarbon phase displays characteristic strong absorption bands between 2800 and 3000 $cm^{-1}$. These absorptions are absent in the spectrum of the bottom mineral phase, indicating that within the detection limits of infrared spectroscopy, essentially all of the bitumen has been removed from the sand. Similarly, the strong bands due to silica observed near 1100 $cm^{-1}$, 800 $cm^{-1}$ and 500 $cm^{-1}$ are absent in the spectrum of the top hydrocarbon phase, indicating that within the detection limits of infrared spectroscopy, the recovered bitumen was not contaminated with fine sand particles. Weak bands near 1030 $cm^{-1}$ indicate that only trace amounts of fine clay particles are present in the top hydrocarbon phase. The ash content of this sample was determined to be 0.3% by weight.

Example 15

In this example, water used in prior art warm water processes and stored in tailing ponds is processed with the systems, methods and compositions disclosed herein. The warm water extraction process presently used to separate bitumen from tar sands in Canada generates large amounts of waste process water mixed with hydrocarbons, extracted sand and minerals. It is presently stored in vast tailing ponds. The water in these ponds is contaminated with residual hydrocarbons (e.g., bitumen) and the chemicals used in processing. It is toxic to aquatic life and has resulted in the death of a large number of ducks. Coarse sand quickly sinks to the bottom of these ponds, while water and some residual bitumen remains on the surface of the pond. A layer of fluid fine tailings and about 6% bitumen contamination sits in between these two layers where water is trapped in a thick soup of mineral fines (mainly clays). Ionic liquids and analogue ionic liquids herein disclosed can also be used to extract hydrocarbons such as, bitumen from tailing ponds material resulting in a flocculation or fast settling of mineral fines.

Figure 25:
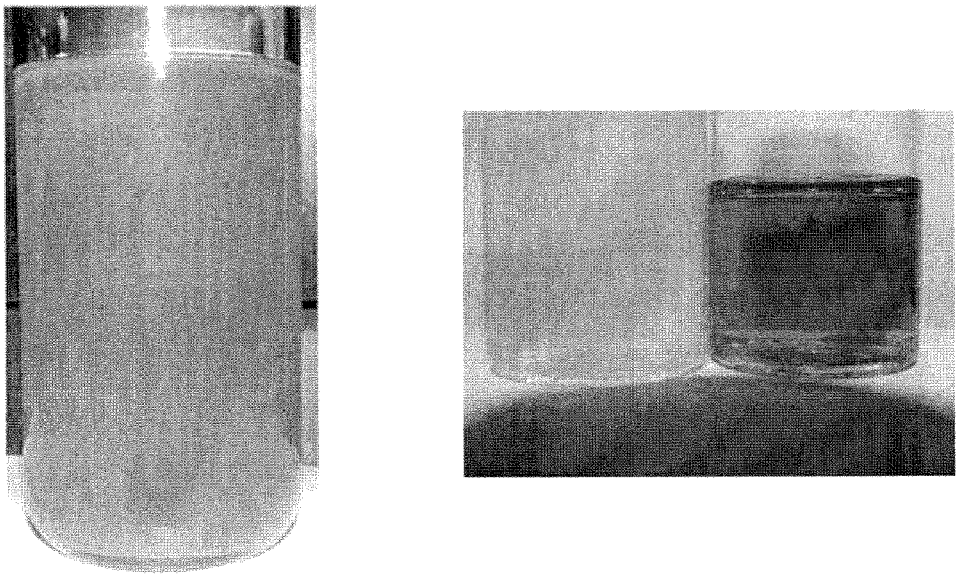
FIG. 25 illustrates tailing pond material before and after separation with the use of an exemplary ionic liquid according to one embodiment.

FIG. 25 illustrates tailing pond material before and after separation with the use of an exemplary ionic liquid. The far left container in FIG. 25 illustrates a dilute but cloudy suspension of mineral fines and settled solids obtained from the top liquid layer in a drum of tailing pond liquids. The containers on the right of FIG. 25 illustrate the top liquid layer before (middle container) and after (far right container) addition of the ionic liquid 1-ethyl-3-methyl-imidazolium chloride. The ionic liquid 1-ethyl-3-methyl-imidazolium chloride was added as a solid to obtain a concentration of 50% by weight in the top liquid layer (other concentrations are also effective). Upon stirring, the suspension became clear in seconds. The liquid turned yellow due to the yellow color and lower purity (95%) of the ionic liquid used. Agglomerated or flocculated mineral particles could be observed at the bottom of the far right container shown in FIG. 25 Mineral fines in tailing ponds can take years to settle. Therefore, it was surprising to achieve settling so rapidly with the use of exemplary ionic liquids.

Example 16

In this example, tailing pond material was processed with the use of exemplary analogue ionic liquids. Analogue ionic liquids herein disclosed can also be used to extract hydrocarbons (e.g., bitumen) from tailing pond material resulting in a flocculation or fast settling of mineral fines. A dilute but cloudy suspension of mineral fines and settled solids obtained from the top liquid layer in a drum of tailing pond liquids was used as particulate matter in this example. An analogue ionic liquid of choline chloride and urea combined in the proportions 1.4 to 1.2 by weight was mixed with the tailing pond material to produce a concentration of 50% by weight analogue ionic liquid in the tailing pond material. Separately, another exemplary analogue ionic liquid was formed by mixing choline chloride and tailing pond material at a concentration of 80% by weight choline chloride in 20% by weight water.

Figure 26:
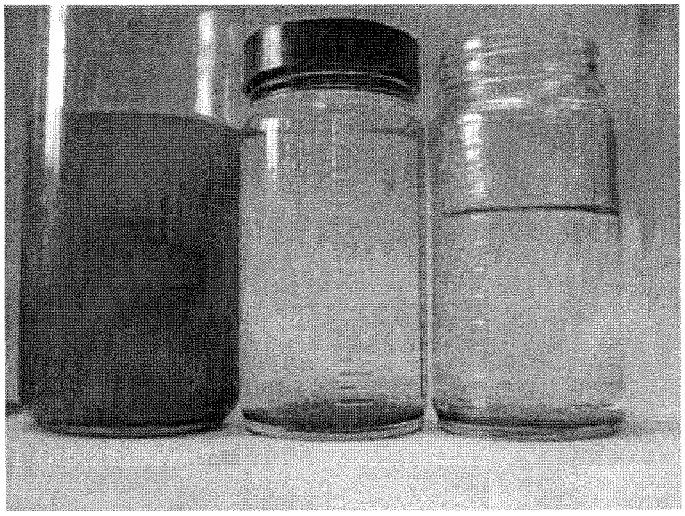
FIG. 26 illustrates tailing pond material before and after separation with the use of exemplary analogue ionic liquids according to one embodiment.

FIG. 26 illustrates tailing pond material before and after separation with the use of exemplary analogue ionic liquids. The far left container of FIG. 26 illustrates a dilute but cloudy suspension of mineral fines and settled solids obtained from the top liquid layer in a drum of tailing pond liquids. The middle container of FIG. 26 illustrates the tailing pond material after mixing with the analogue ionic liquid according to Example 16. The far right container of FIG. 26 illustrates a tailing pond suspension after addition of sufficient analogue ionic liquid to bring the concentration of analogue ionic liquid to 80% by weight in tailing pond material.

All containers of FIG. 26 were stirred to dissolve the analogue ionic liquid. After being left to stand overnight for about 16 hours, the liquid layers in the containers of FIG. 26 appeared clear. The tailing pond material in the far left container of FIG. 26 containing no analogue ionic liquid was also left to settle for the same amount of time as the middle and far right containers. The agglomerated and flocculated mineral particles can be observed at the bottom of the middle and far right container of FIG. 26.

Example 17

Figure 27:
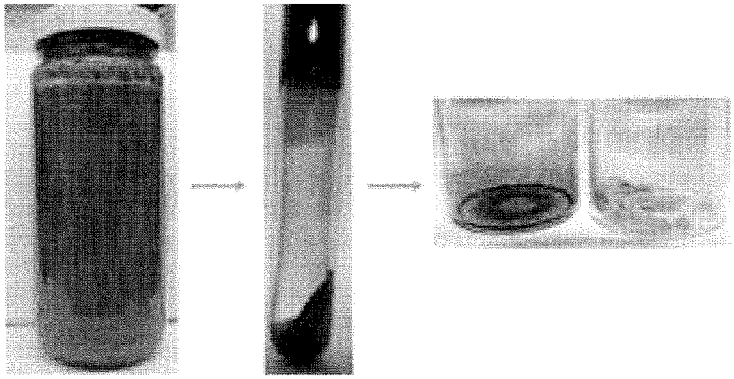
FIG. 27 illustrates concentrated tailing pond material before and after separation with the use of an exemplary analogue ionic liquid according to another embodiment.

In this example, concentrated tailing pond material is processed with the use of an exemplary analogue ionic liquid. FIG. 27 illustrates concentrated tailing pond material before and after separation with the use of an exemplary analogue ionic liquid. The far right container of FIG. 27 illustrates a 30% by weight suspension of mineral solids in tailing pond liquids. A analogue ionic liquid of 50% by weight choline chloride and urea in water was produced. The analogue ionic liquid and an organic solvent were mixed with the concentrated tailing pond material for about 1 minute and centrifuged at 800 rpm. As show in the middle container of FIG. 27, a sharp phase separation was achieved and a top hydrocarbon phase and a bottom mineral phase were formed. The bottom mineral phase was dried and organic solvent was removed from the top hydrocarbon phase to produce a sample of bitumen and sand in the right containers of FIG. 27. Similar results were obtained using imidazolium ionic liquids such as 1-ethyl-3-methyl-imidazolium chloride.

Example 18

In this example, tailing pond material and Canadian tar sands were processed with the use of an exemplary analogue ionic liquid. An analogue ionic liquid was produced by mixing 75% by weight choline chloride and urea in water at a proportion of 1.4 parts by weight choline chloride and 1.2 parts by weight urea. 1 part by weight Canadian tar sands was mixed with the analogue ionic liquid, 2 parts by weight tailing pond material and 1 part by weight toluene. After stirring for a few minutes at ambient temperatures (about 20° C.), vials containing these samples were allowed to stand. Phase separation occurred over a period of about one hour due to the immiscibilty and density differences of the hydrocarbon and analogue ionic liquid phases.

Figure 28:
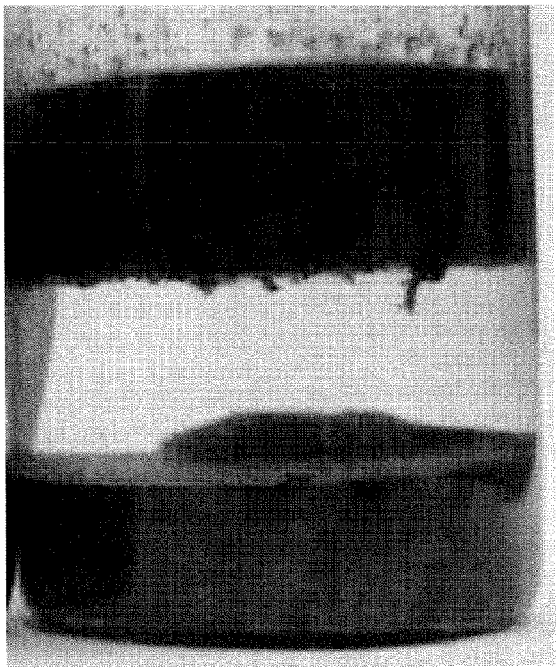
FIG. 28 illustrates an exemplary three phase system formed from mixing an exemplary analogue ionic liquid with Canadian tar sands and tailing pond material according to one embodiment.

FIG. 28 illustrates an exemplary three phase system formed from mixing an exemplary analogue ionic liquid with Canadian tar sands and tailing pond material according to Example 18. The phase-separated layers are shown in FIG. 28, which illustrates a top bitumen phase a middle phase containing analogue ionic liquid and water and a bottom sand phase. The bottom sand phase contained no detectable bitumen, and the top bitumen phase showed only trace amounts of clays, as determined by infrared spectroscopy. The intensities of the clay bands were equivalent to those bitumen samples having an ash content of 0.3% by weight.

Example 19

In this example, Canadian tar sands was processed using an exemplary analogue ionic liquid. The analogue ionic liquid was produced by mixing 80% by weight choline chloride with 20% by weight water. 1 part by weight Canadian tar sands was mixed with 1 part by weight analogue ionic liquid in water and 1 part by weight toluene and stirred in a container at room temperature. The mixture was allowed to stand for 1 hour. Upon centrifugation at 3000 rpm for 15 minutes, a phase separation into three distinct phases occurred.

Figure 29:
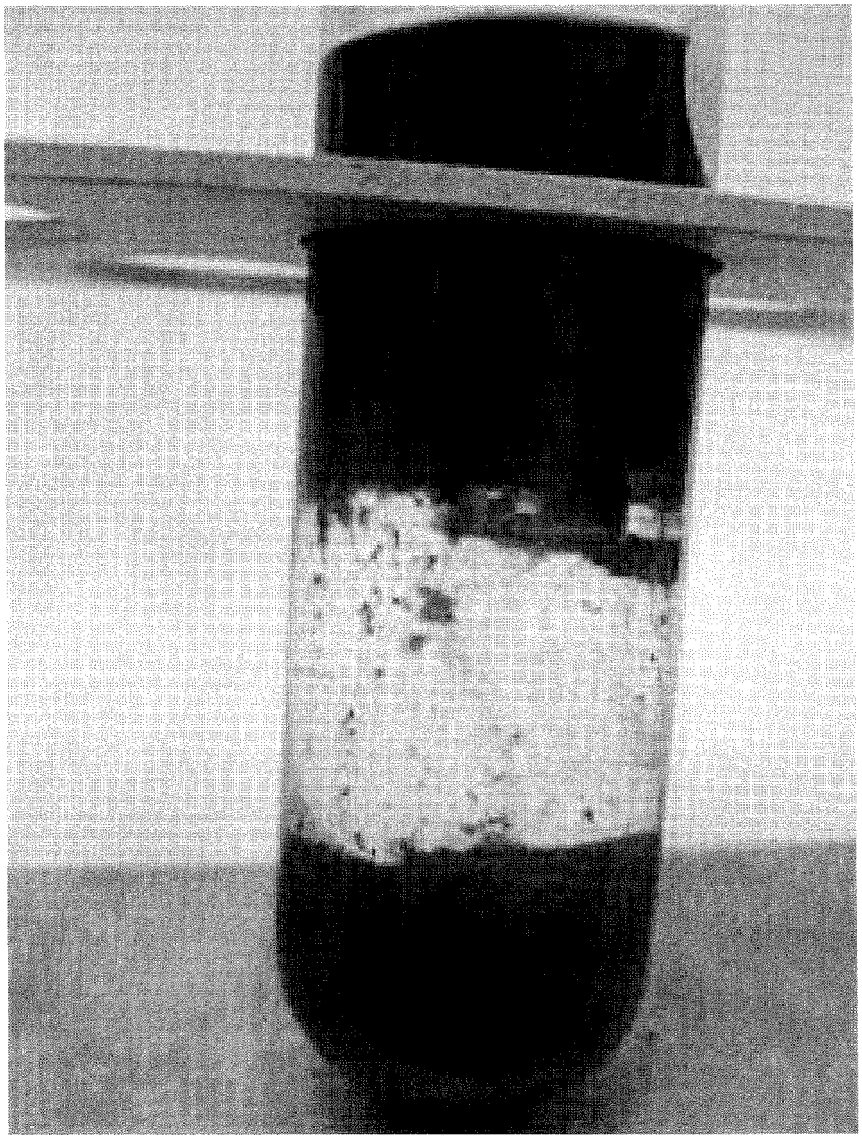
FIG. 29 illustrates an exemplary three phase system formed from mixing an exemplary analogue ionic liquid with Canadian tar sands according to another embodiment.

FIG. 29 illustrates an exemplary three phase system formed from mixing an exemplary analogue ionic liquid with Canadian tar sands according to Example 19. A separation into three phases was achieved. The top hydrocarbon phase consisted of a solution of bitumen in toluene, with trace amounts of clays. The bottom mineral phase contained detectable but small amounts of bitumen. The middle phase consisted of analogue ionic liquid in water.

Figure 30:
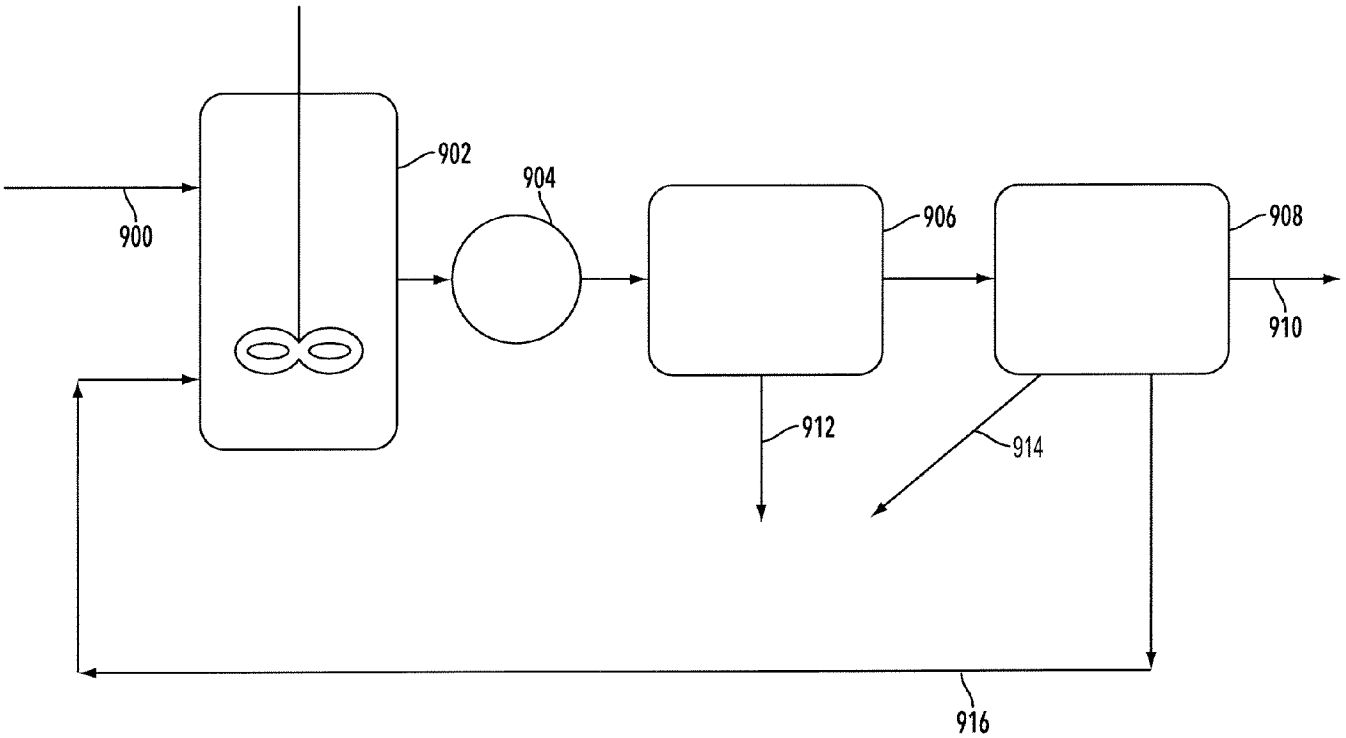
FIG. 30 illustrates an exemplary system for recovering hydrocarbons from particulate matter with the use of the exemplary ionic liquids or analogue ionic liquids according to one embodiment.

FIG. 30 illustrates an exemplary system for recovering hydrocarbons from particulate matter with the use of the exemplary ionic liquids or analogue ionic liquids according to one embodiment. The ionic liquids and analogue ionic liquids herein disclosed can be used in the system illustrated in FIG. 30 to separate hydrocarbons from particulate matter including but not limited to oil sands, drilling fluid containing drill cuttings, tailing pond material, crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate.

The system includes a mixing vessel 902 wherein a feed stream 900 of particulate matter, ionic liquid or analogue ionic liquid and optionally an organic solvent, water or combinations thereof are fed and mixed. The feed stream 900 can also be split into one or more streams containing one or more streams of particulate matter, ionic liquid, analogue ionic liquid, organic solvent, water or combinations thereof.

The feed stream remains in the mixing vessel 902 for a predetermined or average residence time sufficient to allow phase separation and break up of larger mineral/hydrocarbon particles (e.g., tar sand balls). The separation is accelerated by the application of shear forces. Therefore, the feed stream can be placed in slurry form and also fed through a high-shear mixer 904 to assure detachment of hydrocarbons from sand or other minerals.

An inclined plate separator 906 can be used to separate ionic liquid, analogue ionic liquid, liquid hydrocarbons or organic solvent from solid particulate such as silica, sand, clay, other minerals or drill cuttings. The separator 906 can be a centrifuge, hydrocyclone, settling chamber or other separator known in the art for separating particulates from liquids. A solid particulate product stream 912 can be provided to recover solid particulate free of hydrocarbons generated in the inclined plate separator 906. The solid particulate can be washed with water to remove any ionic liquid, analogue ionic liquid or organic solvent used during processing. However, because small amounts of analogue ionic liquid herein disclosed are non-toxic, biodegradable and actually support plant growth, washing is optionally when using analogue ionic liquid.

A liquid phase separator 908 can be used to separate immiscible process liquids. For example, the liquid phase separator can be used to separate ionic liquid or analogue ionic liquid from the oil or bitumen or organic hydrocarbon solvent. The liquid phase separator 908 can be a continuous coalescing separator or other unit known to the art for separating liquids. The liquid phase separator 908 can simultaneously allow the separation of any fines that have carried over from other process streams or units. The liquid phase separator 908 can operate at room temperature (e.g., about 20° C.). If necessary, higher temperatures can be used during separation. A mineral fines product stream 914 can be provided to recover any mineral fines generated in the liquid phase separator 908. A hydrocarbon product stream 910 can be provided to recover hydrocarbons free of solid particulate generated in the liquid phase separator 908.

Any ionic liquid or analogue ionic liquid recovered from the liquid phase separator 908 can be recycled in a recycle stream 916 and mixed with additional feed stream 900 components in the mixing vessel 902.

Example embodiments have been described hereinabove regarding improved systems, methods and compositions for the separation and recovery of hydrocarbons from particulate matter. The systems, methods and compositions herein disclosed require significantly less water and less energy to recover hydrocarbons in processes such as the recovery of bitumen from oil sands. Various modifications to and departures from the disclosed example embodiments will occur to those having ordinary skill in the art. The subject matter that is intended to be within the spirit of this disclosure is set forth in the following claims.

What is claimed is:

1. A method of separating a hydrocarbon from solid particulate, the method comprising:

contacting a particulate matter comprising at least one hydrocarbon and at least one solid particulate with a separating liquid to separate the at least one hydrocarbon from the solid particulate;

wherein the separating liquid comprises at least 25 percent by weight of at least one analogue ionic liquid which includes a hydroxy substituted tetraalkyl ammonium salt and at least one of urea, carboxylic acid, glycerol, a metal salt, water, an organic halide salt, an organic hydrogen bond donor, fructose, sucrose or glucose; and wherein the separating liquid separates at least 90% of the at least one hydrocarbon from the solid particulate.

2. The method as recited in claim 1, further comprising recovering the at least one hydrocarbon.

3. The method as recited in claim 2, further comprising recovering the at least one solid particulate.

4. The method as recited in claim 1, wherein the separating liquid further comprises at least one organic solvent.

5. The method as recited in claim 1, wherein contacting the particulate matter comprises contacting the particulate matter at a temperature of less than or equal to 100° C.

6. The method as recited in claim 1, wherein contacting the particulate matter comprises contacting the particulate matter at a temperature of less than or equal to 50° C.

7. The method as recited in claim 1, further comprising permitting the at least one hydrocarbon, solid particulate and separating liquid to form a multiphase system and separating the hydrocarbon from the multiphase system by any one or more steps of: decanting at least a portion of the multiphase system, evaporating at least a portion of the multiphase system, distilling at least a portion of the multiphase system, centrifuging at least a portion of the multi phase system or filtrating at least a portion of the multi phase system.

8. The method as recited in claim 1, wherein the at least one hydrocarbon comprises at least one hydrocarbon selected from the group consisting of: bitumen, oil and drilling fluid.

9. The method as recited in claim 1, wherein the at least one solid particulate comprises at least one solid particulate selected from the group consisting of: sand, soil, silt, clay, rock, minerals and drill cuttings.

10. The method as recited in claim 7, wherein the multiphase system comprises three phases.

11. The method as recited in claim 4, wherein the at least one organic solvent is at least one organic solvent selected from the group consisting of: toluene, naphtha, hexane, kerosene and paraffinic solvents.

12. The method as recited in claim 1, wherein the analogue ionic liquid comprises a hydroxy substituted tetraalkyl ammonium salt and urea.

13. The method as recited in claim 12, wherein the hydroxy substituted tetraalkyl ammonium salt is choline chloride.

14. The method as recited in claim 1, wherein the analogue ionic liquid comprises a hydroxy substituted tetraalkyl ammonium salt and an organic hydrogen bond donor.

15. The method as recited in claim 14, wherein the organic hydrogen bond donor is selected from the group consisting of glycerol, ethylene glycol and triethylene glycol.

16. The method as recited in claim 15, wherein the hydroxy substituted tetraalkyl ammonium salt is choline chloride.

17. The method as recited in claim 1, wherein the separating liquid further comprises water to form a solution of the analogue ionic liquid.

18. The method as recited in claim 1, wherein the particulate matter includes oil sands and the at least one hydrocarbon includes bitumen.

19. The method as recited in claim 13, wherein the particulate matter includes oil sands and the at least one hydrocarbon includes bitumen.

20. The method as recited in claim 1, wherein the contacting step includes mixing oil sands composed of bitumen and sand as the particulate matter with the separating liquid which further includes an organic solvent; and further comprising allowing the mixture to form a three phase system comprising a top phase including the bitumen, a middle phase including the analogue ionic liquid and a bottom phase including the sand; and separating the top phase from the other phases to recover the bitumen.

* * * * *